US011008527B2

(12) United States Patent
Loper

(10) Patent No.: US 11,008,527 B2
(45) Date of Patent: May 18, 2021

(54) ENGINE OILS FOR SOOT HANDLING AND FRICTION REDUCTION

(71) Applicant: Afton Chemical Corporation, Richmond, VA (US)

(72) Inventor: John Loper, Henrico, VA (US)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 16/251,459

(22) Filed: Jan. 18, 2019

(65) Prior Publication Data

US 2020/0231892 A1 Jul. 23, 2020

(51) Int. Cl.
*C10M 141/06* (2006.01)
*C10M 129/34* (2006.01)
(Continued)

(52) U.S. Cl.
CPC ..... *C10M 141/06* (2013.01); *C10M 129/34* (2013.01); *C10M 129/64* (2013.01); *C10M 133/06* (2013.01); *C10M 133/56* (2013.01); *C10M 2207/12* (2013.01); *C10M 2207/282* (2013.01); *C10M 2215/04* (2013.01); *C10M 2215/28* (2013.01); *C10N 2030/06* (2013.01);
(Continued)

(58) Field of Classification Search
CPC ..... C10M 169/04; C10M 141/06; C10M 133/06; C10M 133/56; C10M 129/34; C10M 129/64; C10M 2207/12; C10M 2207/282; C10M 2215/04; C10M 2215/28; C10N 2030/06; C10N 2030/50; C10N 2030/54; C10N 2030/56; C10N 2030/78; C10N 2040/25; C10N 2040/252
See application file for complete search history.

(56) References Cited

U.S. PATENT DOCUMENTS 3,219,666 A 11/1965 Norman et al.
3,565,804 A 2/1971 Honnen et al.
(Continued)

FOREIGN PATENT DOCUMENTS

EP 3527651 A1 8/2019
JP 2008127435 A 6/2008

OTHER PUBLICATIONS

International Search Report and Written Opinion for corresponding International application No. PCT/US2019/064934; dated Mar. 26, 2020 (14 pages).

*Primary Examiner* — James C Goloboy
(74) *Attorney, Agent, or Firm* — Mendelsohn Dunleavy, P.C.

(57) ABSTRACT

Engine oil \s and methods for use in soot-producing engines. The engine oil contains a major amount of a base oil and a dispersant reaction product of A) a hydrocarbyl-dicarboxylic acid or anhydride, and B) at least one polyamine, that is post-treated with C) an aromatic carboxylic acid, an aromatic polycarboxylic acid, or an aromatic anhydride, wherein all carboxylic acid or anhydride groups of C) are attached directly to an aromatic ring. A molar ratio of carboxyl groups from components A) and C) to nitrogen atoms from component B) of from 0.9 to 1.3 is used to make the dispersant which also has a molar ratio of component C) to component B) of at least 0.4 and when component B) has an average of 4-6 nitrogen atoms per molecule, a molar ratio of A) to B) is from 1.0 to 1.6.

12 Claims, 2 Drawing Sheets

(51) Int. Cl.

| | |
|---|---|
| ***C10M 129/64*** | (2006.01) |
| ***C10M 133/06*** | (2006.01) |
| ***C10M 133/56*** | (2006.01) |
| ***C10N 30/00*** | (2006.01) |
| ***C10N 40/25*** | (2006.01) |
| ***C10N 30/06*** | (2006.01) |

(52) U.S. Cl.
CPC ..... *C10N 2030/50* (2020.05); *C10N 2030/54* (2020.05); *C10N 2030/56* (2020.05); *C10N 2030/78* (2020.05); *C10N 2040/25* (2013.01); *C10N 2040/252* (2020.05)

(56) References Cited

U.S. PATENT DOCUMENTS

| | | | | |
|---|---|---|---|---|
| 3,634,515 | A | 1/1972 | Piasek et al. | |
| 3,697,574 | A | 10/1972 | Piasek et al. | |
| 3,736,357 | A | 5/1973 | Piasek et al. | |
| 4,234,435 | A | 11/1980 | Meinhardt et al. | |
| 4,636,322 | A | 1/1987 | Nalesnik | |
| 5,204,012 | A | 4/1993 | Schaffhausen | |
| 5,241,003 | A | 8/1993 | Degonia et al. | |
| 5,334,321 | A | 8/1994 | Harrison et al. | |
| 5,627,259 | A | 5/1997 | Thaler et al. | |
| 5,633,326 | A | 5/1997 | Patil et al. | |
| 5,643,859 | A | 7/1997 | Gutierrez et al. | |
| 5,739,355 | A | 4/1998 | Gateau et al. | |
| 5,792,729 | A | 8/1998 | Harrison et al. | |
| 5,851,965 | A | 12/1998 | Harrison et al. | |
| 5,853,434 | A | 12/1998 | Harrison et al. | |
| 5,936,041 | A | 8/1999 | Diana et al. | |
| 6,034,040 | A | 3/2000 | Ozbalik et al. | |
| 6,548,458 | B2 | 4/2003 | Loper | |
| 7,214,649 | B2 | 5/2007 | Loper et al. | |
| 7,645,726 | B2 | 1/2010 | Loper | |
| 7,897,696 | B2 | 3/2011 | Huang et al. | |
| 8,048,831 | B2 | 11/2011 | Loper | |
| 8,927,469 | B2 | 1/2015 | Mathur et al. | |
| 2009/0011963 | A1* | 1/2009 | Anderson | C10M 167/00 508/192 |
| 2017/0335228 | A1* | 11/2017 | Campbell | C10M 161/00 |
| 2018/0016515 | A1* | 1/2018 | Lagona | C10M 169/04 |

* cited by examiner

ENGINE OILS FOR SOOT HANDLING AND FRICTION REDUCTION

TECHNICAL FIELD

The disclosure relates to engine oil compositions and to dispersants for improving friction properties and/or maintaining the soot or sludge handling characteristics of an engine oil composition, while reducing or minimizing the treat rate of the dispersants in the engine oil composition.

BACKGROUND

Engine lubricant compositions may be selected to provide increased engine protection, as well as an increase in fuel economy, and a reduction in emissions. However, in order to achieve benefits of improved fuel economy and reduced emissions, a balance between engine protection and lubricating properties is required. For example, an increase in the amount of friction modifiers may be beneficial for improving fuel economy, but may lead to reduced ability of the lubricant composition to handle water. Likewise, an increase in the amount of anti-wear agent in the lubricant may provide improved engine protection against wear but may be detrimental to catalyst performance for reducing emissions.

One of the reasons that dispersants are added to lubricant compositions is to maintain soot and/or sludge in suspension and thereby prevent these contaminants from settling on and/or adhering to surfaces. As the amount of dispersant(s) in a lubricant composition is increased, typically, the soot and sludge handling properties of the lubricant are improved. In heavy duty diesel engines, the dispersant treat rates required for effective soot and sludge handling may be quite high. High dispersant treat rates, however, may increase corrosion and can be harmful to seals.

Dispersant(s) and/or dispersant treat rates may also influence the frictional properties of an engine oil composition. More specifically, the thin film and/or boundary layer friction properties of an engine oil can be influenced by dispersant(s) and/or dispersant treat rates. As a result, there is a need in the field of engine oils to balance the soot and/or sludge handling properties of dispersants with the thin film and/or boundary layer frictional properties of the engine oils containing the dispersants.

Accordingly, there is a need for a dispersant or a dispersant combination that can provide satisfactory soot and/or sludge handling properties to a lubricant composition at a relatively low dispersant treat rate, as well as provide acceptable or improved thin film and/or boundary layer friction properties to an engine oil composition. Such lubricant compositions should be suitable for meeting or exceeding currently proposed and future lubricant performance standards.

SUMMARY AND TERMS

The present disclosure relates to engine oils including a dispersant, to methods of using these engine oils for lubricating an engine and uses of these dispersants and engine oils. In a first aspect, the disclosure relates to an engine oil composition including 50 wt. % to about 99 wt. % of a base oil, based on the total weight of the engine oil composition, and a dispersant that is a reaction product of A) a hydrocarbyl-dicarboxylic acid or anhydride and B) at least one polyamine, that is post-treated with C) an aromatic carboxylic acid, an aromatic polycarboxylic acid, or an aromatic anhydride. All carboxylic acid or anhydride groups of C) used for post-treatment are attached directly to an aromatic ring. The dispersant is made using a molar ratio of carboxyl groups from components A) and C) to nitrogen atoms from component B) of from 0.9 to 1.3, or from 1.0 to 1.3, a molar ratio of the moles of C) to moles of B) of at least 0.4, and when component B) has an average of 4-6 nitrogen atoms per molecule, the molar ratio of A) to B) is from 1.0 to 1.6. The engine oil composition comprises at least 0.1 wt. % of the dispersant, based on a total weight of the engine oil composition.

In each of the foregoing embodiments, the molar ratio of carboxyl groups from components A) and C) to nitrogen atoms from component B) may be from 1.0 to 1.3.

In each of the foregoing embodiments, C) may be a dicarboxyl-containing fused aromatic compound or anhydride thereof.

In each of the foregoing embodiments, component C) may be 1,8-naphthalic anhydride.

In each of the foregoing embodiments, when component B) has other than an average of 4-6 nitrogen atoms per molecule, the molar ratio of A) to B) may be from 1.0 to 2.0. or when component B) has an average of 4-6 nitrogen atoms per molecule, the molar ratio of A) to B) may be from 1.1 to 1.8 and when component B) has other than an average of 4-6 nitrogen atoms per molecule, the molar ratio of A) to B) may be from 1.1 to 1.8.

In each of the foregoing embodiments, a molar ratio of component C) to component B) may be from 0.1:1 to 2.5:1, or from 0.2:1 to 2:1, or from 0.25:1 to 1.6:1.

In each of the foregoing embodiments, the hydrocarbyl dicarboxylic acid or anhydride component A) may include a polyisobutenyl succinic acid or anhydride.

In each of the foregoing embodiments, the polyamine B) may be selected from tetraethylenepentamine, triethylenetetraamine, diethylenetriamine, and ethylene diamine and mixtures containing two or more of these polyamines.

In each of the foregoing embodiments, the polyamine B) may be tetraethylenepentamine.

In each of the foregoing embodiments, the dispersant derived from components A)-C) may not be post treated with a non-aromatic dicarboxylic acid or anhydride having a number average molecular weight of less than about 500 g/mol, as measured by GPC using polystyrene as a calibration reference.

In each of the foregoing embodiments, component A) may a polyisobutenyl-substituted succinic anhydride and the dispersant may have a molar ratio of A) polyisobutenyl-substituted succinic anhydride to B) polyamine, in a range of from 1.0 to 2.2; or from 1.1 to 2.0; or from 1.2 to 1.6, except that when component B) has an average of 4-6 nitrogen atoms per molecule, the molar ratio of A) to B) may be from 1.0 to 1.6 or 1.2 to 1.6.

In each of the foregoing embodiments, the amount of the dispersant derived from components A)-C) may be from 0.1-5.0 wt. %, or from 0.25-3.0 wt. %, based on a total weight of the engine oil composition.

In each of the foregoing embodiments, the engine oil may further comprise one or more of detergents, dispersants, friction modifiers, antioxidants, rust inhibitors, viscosity index improvers, emulsifiers, demulsifiers, corrosion inhibitors, antiwear agents, metal dihydrocarbyl dithiophosphates, ash-free amine phosphate salts, antifoam agents, and pour point depressants and any combination thereof.

In each of the foregoing embodiments, the engine oil may contain at least 1.0 wt % soot or from about 2 wt % to about 3 wt % soot.

In each of the foregoing embodiments, the engine oil composition may have a Noack volatility of less than 15 mass % or less than 13 mass %, as measured by the method of ASTM D-5800 at 250° C.

In each of the foregoing embodiments, the engine oil may further comprise at least 0.05 wt. % of a second dispersant. The second dispersant may be a reaction product of D) a hydrocarbyl-dicarboxylic acid or anhydride and E) at least one polyamine, In this embodiment, component D) may be a polyisobutenyl succinic anhydride.

In each of the foregoing embodiments employing the second dispersant, the engine oil compositions may have a weight ratio of the second dispersant to the dispersant reaction product of A) and B) post-treated with C) of from about 0.1:1.0 to 1.0:1.0; or 0.25:1.0 to 0.75:1.0; or 0.4:1.0 to 0.6:1.0.

In each of the foregoing embodiments employing the second dispersant, the hydrocarbyl dicarboxylic acids of D) may comprise a polyisobutenyl succinic acid. In the foregoing embodiment, the second dispersant may have a molar ratio of component D) to E) polyamine in a range of from 1.0 to 2.0; or from 1.1 to 1.8 or from 1.2 to 1.6;

In each of the foregoing embodiments employing the second dispersant, the polyamine E) may be selected from tetraethylenepentamine, triethylenetetraamine, diethylenetriamine, and ethylene diamine.

In each of the foregoing embodiments, the engine oil may include a third dispersant that is different from each of the dispersant reaction product of A) and B) post-treated with C) and the second dispersant. In the foregoing embodiment, the third dispersant may be a reaction product of F) a hydrocarbyl-dicarboxylic acid or anhydride and G) at least one polyamine. In some cases, the third dispersant may be post-treated with H) boric acid. In an embodiment wherein the engine oil may include a third dispersant, the weight ratio of the second dispersant to the dispersant made from components A)-C) to the third dispersant may be from about 1:5:2 to 1:6:2; or 1:4:2 to 1:5:2; or 1:3:2 to 1:4:2.

In each of the foregoing embodiments, the engine oil composition may further include one or more of detergents, dispersants, friction modifiers, antioxidants, rust inhibitors, viscosity index improvers, emulsifiers, demulsifiers, corrosion inhibitors, antiwear agents, metal dihydrocarbyl dithiophosphates, ash-free amine phosphate salts, antifoam agents, and pour point depressants and any combination thereof.

In each of the foregoing embodiments, the engine oil composition may have at least 1.0 wt. % soot, or from about 2 wt. % to about 3 wt. % soot.

In each of the foregoing embodiments, the engine oil composition may have a Noack volatility of less than 15 mass %, or less than 13 mass %.

In each of the foregoing embodiments, neither the dispersant reaction product of A) and B) post-treated with C) nor the second dispersant may be post-treated with a non-aromatic dicarboxylic acid or anhydride having a number average molecular weight of less than about 500 g/mol, as measured by GPC using polystyrene as a calibration reference, or neither the dispersant reaction product of A) and B) post-treated with C) nor the second dispersant may be post-treated with maleic anhydride.

In each of the foregoing embodiments, the dispersant reaction product of A) and B) post-treated with C) may not be post-treated with a non-aromatic hydrocarbyl-dicarboxylic acid or anhydride having a number average molecular weight of less than about 500 g/mol, as measured by GPC using polystyrene as a calibration reference, or the dispersant reaction product of A) and B) post-treated with C) may not be post-treated with maleic anhydride.

In each of the foregoing embodiments, the engine oil may be an engine oil formulated for use in a heavy duty diesel engine.

In a second aspect, the present disclosure relates to a method for lubricating an engine including a step of lubricating an engine with the engine oil composition as set forth in each of the foregoing embodiments.

In a third aspect, the present disclosure relates to a method for maintaining the soot or sludge handling capability of an engine oil composition including a step of adding to the engine oil composition the dispersant as set forth in each of the foregoing embodiments.

In a fourth aspect, the present disclosure relates to a method for improving boundary layer friction in an engine, including a step of lubricating the engine with the engine oil composition as set forth in each of the foregoing embodiments.

In the foregoing embodiment, the improvement in boundary layer friction may be determined relative to a same composition in the absence of the dispersant reaction product of A) and B) post-treated with C).

In a fifth aspect, the present disclosure relates to a method for improving thin film friction in an engine, including a step of lubricating the engine with the engine oil composition as set forth in each of the foregoing embodiments.

In the foregoing embodiment, the improvement in the thin film friction may be determined relative to a same composition in the absence of the dispersant reaction product of A) and B) post-treated with C).

In a sixth aspect, the present disclosure relates to a method for improving a combination of the boundary layer friction and the thin film friction in an engine, including a step of lubricating the engine with the engine oil composition as set forth in each of the foregoing embodiments.

In the foregoing embodiment, the improvement in the combination of the boundary layer friction and the thin film friction may be determined relative to a same composition in the absence of the dispersant reaction product of A) and B) post-treated with C).

The following definitions of terms are provided in order to clarify the meanings of certain terms as used herein.

The terms "oil composition," "lubrication composition," "lubricating oil composition," "lubricating oil," "lubricant composition," "lubricating composition," "fully formulated lubricant composition," "lubricant," are considered synonymous, fully interchangeable terminology referring to the finished lubrication product comprising a major amount of a base oil plus a minor amount of an additive composition.

The terms "crankcase oil," "crankcase lubricant," "engine oil," "engine lubricant," "motor oil," and "motor lubricant" are considered synonymous, fully interchangeable terminology referring to a finished lubricating oil composition suitable for use as an engine oil and comprising a major amount of a base oil plus a minor amount of an additive composition.

As used herein, the terms "additive package," "additive concentrate," "additive composition," are considered synonymous, fully interchangeable terminology referring the portion of the lubricating or engine oil composition excluding the major amount of base oil stock mixture. The additive package may or may not include the viscosity index improver or pour point depressant.

The term "overbased" relates to metal salts, such as metal salts of sulfonates, carboxylates, salicylates, and/or phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, MR, is greater than one. They are commonly referred to as overbased, hyperbased, or superbased salts and may be salts of organic sulfur acids, carboxylic acids, salicylates, and/or phenols.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having a predominantly hydrocarbon character. Each hydrocarbyl group is independently selected from hydrocarbon substituents.

As used herein, the term "percent by weight", unless expressly stated otherwise, means the percentage the recited component represents to the weight of the entire composition.

The terms "soluble," "oil-soluble," or "dispersible" used herein may, but does not necessarily, indicate that the compounds or additives are soluble, dissolvable, miscible, or capable of being suspended in the oil in all proportions. The foregoing terms do mean, however, that they are, for instance, soluble, suspendable, dissolvable, or stably dispersible in oil to an extent sufficient to exert their intended effect in the environment in which the oil is employed. Moreover, the additional incorporation of other additives may also permit incorporation of higher levels of a particular additive, if desired.

The term "TBN" as employed herein is used to denote the Total Base Number in mg KOH/g as measured by the method of ASTM D2896

The term "alkyl" as employed herein refers to straight, branched, cyclic, and/or substituted saturated chain moieties of from about 1 to about 100 carbon atoms.

The term "alkenyl" as employed herein refers to straight, branched, cyclic, and/or substituted unsaturated chain moieties of from about 3 to about 10 carbon atoms.

The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, oxygen, and sulfur.

As used herein, all molar ratios are determined based on the amounts and types of reactants A)-C) charged to the reactor to make the dispersant.

Lubricants, engine oils, combinations of components, or individual components of the present description may be suitable for use in various types of internal combustion engines. Suitable engine types may include, but are not limited to heavy duty diesel, passenger car, light duty diesel, medium speed diesel, or marine engines. An internal combustion engine may be a diesel fueled engine, a gasoline fueled engine, a natural gas fueled engine, a bio-fueled engine, a mixed diesel/biofuel fueled engine, a mixed gasoline/biofuel fueled engine, an alcohol fueled engine, a mixed gasoline/alcohol fueled engine, a compressed natural gas (CNG) fueled engine, or mixtures thereof. A diesel engine may be a compression ignited engine. A gasoline engine may be a spark-ignited engine. An internal combustion engine may also be used in combination with an electrical or battery source of power. An engine so configured is commonly known as a hybrid engine. The internal combustion engine may be a 2-stroke, 4-stroke, or rotary engine. Suitable internal combustion engines include marine diesel engines (such as inland marine), aviation piston engines, low-load diesel engines, and motorcycle, automobile, locomotive, and truck engines.

Advantageous types of engines for which the engine oil compositions of the present invention may be used are heavy duty diesel (HDD) engines.

HDD engines are commonly known to produce soot levels in lubricants in the range of about 1% to about 3%. Additionally, in older model HDD engines the soot level could reach levels of up to about 8%.

Additionally, gasoline direct injection (GDi) engines also produce soot in their lubricants. A test of a GDi engine using the Ford Chain Wear Test run for 312 hours produced a soot level of 2.387% in the lubricant. Depending on the manufacturer and operating conditions the soot levels in direct fuel injection gasoline engines can be in the range of about 1.5% to about 3%. For comparison a non-direct injection gasoline engine was also tested to determine the soot amounts produced in the lubricant. The results of this test showed only about 1.152% soot in the lubricant.

Based on the higher levels of soot produced by HDD and GDi engines, the present dispersant is suitable for use with these types of engines. For use in HDD engines and direct fuel injected gasoline engines the soot present in the oil can range from about 0.05% to about 8% depending on the age, manufacturer, and operating conditions of the engine. In some embodiments, the soot level in the engine oil composition is greater than about 1.0%, or the soot level is from about 1.0% to about 8%, or the soot level in the engine oil composition is from about 2% to about 3%.

The internal combustion engine may contain components of one or more of an aluminum-alloy, lead, tin, copper, cast iron, magnesium, ceramics, stainless steel, composites, and/or mixtures thereof. The components may be coated, for example, with a diamond-like carbon coating, a lubrited coating, a phosphorus-containing coating, molybdenum-containing coating, a graphite coating, a nano-particle-containing coating, and/or mixtures thereof. The aluminum-alloy may include aluminum silicates, aluminum oxides, or other ceramic materials. In one embodiment the aluminum-alloy is an aluminum-silicate surface. As used herein, the term "aluminum alloy" is intended to be synonymous with "aluminum composite" and to describe a component or surface comprising aluminum and another component intermixed or reacted on a microscopic or nearly microscopic level, regardless of the detailed structure thereof. This would include any conventional alloys with metals other than aluminum as well as composite or alloy-like structures with non-metallic elements or compounds such with ceramic-like materials.

The engine oil composition for an internal combustion engine may be suitable for use as any engine lubricant irrespective of the sulfur, phosphorus, or sulfated ash (ASTM D-874) content. The sulfur content of the engine oil may be about 1 wt % or less, or about 0.8 wt % or less, or about 0.5 wt % or less, or about 0.3 wt % or less, or about 0.2 wt % or less. In one embodiment the sulfur content may be in the range of about 0.001 wt % to about 0.5 wt %, or about 0.01 wt % to about 0.3 wt %. The phosphorus content may be about 0.2 wt % or less, or about 0.1 wt % or less, or about 0.085 wt % or less, or about 0.08 wt % or less, or even about 0.06 wt % or less, about 0.055 wt % or less, or about 0.05 wt % or less. In one embodiment the phosphorus content may be about 50 ppm to about 1000 ppm, or about 325 ppm to about 850 ppm. The total sulfated ash content may be about 2 wt % or less, or about 1.5 wt % or less, or about 1.1 wt % or less, or about 1 wt % or less, or about 0.8 wt % or less, or about 0.5 wt % or less. In one embodiment the sulfated ash content may be about 0.05 wt % to about 0.9 wt %, or about 0.1 wt % or about 0.2 wt % to about 0.45 wt %. In another embodiment, the sulfur content may be about 0.4 wt % or less, the phosphorus content may be about 0.08 wt % or less, and the sulfated ash is about 1 wt % or less. In yet another embodiment the sulfur content may be about 0.3 wt % or less, the phosphorus content is about 0.05 wt % or less, and the sulfated ash may be about 0.8 wt % or less.

In one embodiment the engine oil may have (i) a sulfur content of about 0.5 wt % or less, (ii) a phosphorus content of about 0.1 wt % or less, and (iii) a sulfated ash content of about 1.5 wt % or less. In some embodiments for heavy duty diesel motor oil (HDEO) applications, the amount of phosphorus in the finished fluid is 1200 ppm or less or 1000 ppm or less or 900 ppm or less, or 800 ppm or less. In some embodiments for passenger car motor oil (PCMO) applications, the amount of phosphorus in the finished fluid is 1000 ppm or less or 900 ppm or less or 800 ppm or less.

The engine oil may contain at least 1.0 wt % soot or from about 2 wt % to about 3 wt % soot.

The engine oil composition may have a Noack volatility of less than 15 mass % or less than 13 mass %, as measured by the method of ASTM D-5800 at 250° C.

In one embodiment the engine oil composition is suitable for a 2-stroke or a 4-stroke marine diesel internal combustion engine. In one embodiment the marine diesel combustion engine is a 2-stroke engine. In some embodiments, the engine oil composition is not suitable for a 2-stroke or a 4-stroke marine diesel internal combustion engine for one or more reasons, including but not limited to, the high sulfur content of fuel used in powering a marine engine and the high TBN required for a marine-suitable engine oil (e.g., above about 40 TBN in a marine-suitable engine oil).

In some embodiments, the engine oil composition is suitable for use with engines powered by low sulfur fuels, such as fuels containing about 1 to about 5 wt. % sulfur. Highway vehicle fuels contain about 15 ppm sulfur (or about 0.0015 wt % sulfur).

Fully formulated engine oils conventionally contain an additive package, referred to herein as a dispersant/inhibitor package or DI package, that will supply the characteristics that are required in the formulations. Suitable DI packages are described for example in U.S. Pat. Nos. 5,204,012 and 6,034,040 for example. Among the types of additives included in the additive package may be dispersants, seal swell agents, antioxidants, foam inhibitors, lubricity agents, rust inhibitors, corrosion inhibitors, demulsifiers, viscosity index improvers, and the like. Several of these components are well known to those skilled in the art and are generally used in conventional amounts with the additives and compositions described herein.

Low speed diesel typically refers to marine engines, medium speed diesel typically refers to locomotives, and high speed diesel typically refers to highway vehicles. The engine oil composition may be suitable for only one of these types or all.

Further, engine oils of the present description may be suitable to meet one or more industry specification requirements such as ILSAC GF-3, GF-4, GF-5, GF-6, PC-11, CF, CF-4, CH-4, CK-4, FA-4, CJ-4, CI-4 Plus, CI-4, API SG, SJ, SL, SM, SN, ACEA A1/B1, A2/B2, A3/B3, A3/B4, A5/B5, C1, C2, C3, C4, C5, E4/E6/E7/E9, Euro 5/6, JASO DL-1, Low SAPS, Mid SAPS, or original equipment manufacturer specifications such as Dexos™ 1, Dexos™2, MB-Approval 229.1, 229.3, 229.5, 229.51/229.31, 229.52, 229.6, 229.71, 226.5, 226.51, 228.0/.1, 228.2/.3, 228.31, 228.5, 228.51, 228.61, VW 501.01, 502.00, 503.00/503.01, 504.00, 505.00, 505.01, 506.00/506.01, 507.00, 508.00, 509.00, 508.88, 509.99, BMW Longlife-01, Longlife-01 FE, Longlife-04, Longlife-12 FE, Longlife-14 FE+, Longlife-17 FE+, Porsche A40, C30, Peugeot Citroen Automobiles B71 2290, B71 2294, B71 2295, B71 2296, B71 2297, B71 2300, B71 2302, B71 2312, B71 2007, B71 2008, Renault RN0700, RN0710, RN0720, Ford WSS-M2C153-H, WSS-M2C930-A, WSS-M2C945-A, WSS-M2C913A, WSS-M2C913-B, WSS-M2C913-C, WSS-M2C913-D, WSS-M2C948-B, WSS-M2C948-A, GM 6094-M, Chrysler MS-6395, Fiat 9.55535 G1, G2, M2, N1, N2, Z2, S1, S2, S3, S4, T2, DS1, DSX, GH2, GS1, GSX, CR1, Jaguar Land Rover STJLR.03.5003, STJLR.03.5004, STJLR.03.5005, STJLR.03.5006, STJLR.03.5007STJLR.51.5122 or any past or future PCMO or HDD specifications not mentioned herein Other hardware may not be suitable for use with the disclosed lubricant. A "functional fluid" is a term which encompasses a variety of fluids including but not limited to tractor hydraulic fluids, power transmission fluids including automatic transmission fluids, continuously variable transmission fluids and manual transmission fluids, hydraulic fluids, including tractor hydraulic fluids, some gear oils, power steering fluids, fluids used in wind turbines, compressors, some industrial fluids, and fluids related to power train components. It should be noted that within each of these fluids such as, for example, automatic transmission fluids, there are a variety of different types of fluids due to the various transmissions having different designs which have led to the need for fluids of markedly different functional characteristics. This is contrasted by the term "engine oil" which refers to a lubricant that is not used to generate or transfer power.

With respect to tractor hydraulic fluids, for example, these fluids are all-purpose products used for all lubricant applications in a tractor except for lubricating the engine. These lubricating applications may include lubrication of gearboxes, power take-off and clutch(es), rear axles, reduction gears, wet brakes, and hydraulic accessories.

When the functional fluid is an automatic transmission fluid, the automatic transmission fluids must have enough friction for the clutch plates to transfer power. However, the friction coefficient of fluids has a tendency to decline due to the temperature effects as the fluid heats up during operation. It is important that the tractor hydraulic fluid or automatic transmission fluid maintain its high friction coefficient at elevated temperatures, otherwise brake systems or automatic transmissions may fail. This is not a function of an engine oil.

Tractor fluids, and for example Super Tractor Universal Oils (STUOs) or Universal Tractor Transmission Oils (UTTOs), may combine the performance of engine oils with transmissions, differentials, final-drive planetary gears, wet-brakes, and hydraulic performance. While many of the additives used to formulate a UTTO or a STUO fluid are similar in functionality, they may have deleterious effect if not incorporated properly. For example, some anti-wear and extreme pressure additives used in engine oils can be extremely corrosive to the copper components in hydraulic pumps. Detergents and dispersants used for gasoline or diesel engine performance may be detrimental to wet brake performance. Friction modifiers specific to quiet wet brake noise, may lack the thermal stability required for engine oil performance. Each of these fluids, whether functional, tractor, engine or lubricating, are designed to meet specific and stringent manufacturer requirements.

Engine oils of the present disclosure may be formulated by the addition of one or more additives, as described in detail below, to an appropriate base oil formulation. The additives may be combined with a base oil in the form of an additive package (or concentrate) or, alternatively, may be combined individually with a base oil (or a mixture of both). The fully formulated engine oil may exhibit improved performance properties, based on the additives added and their respective proportions.

Additional details and advantages of the disclosure will be set forth in part in the description which follows, and/or may be learned by practice of the disclosure. The details and advantages of the disclosure may be realized and attained by means of the elements and combinations particularly pointed out in the appended claims. It is to be understood that both the foregoing general description and the following detailed description are exemplary and explanatory only and are not restrictive of the disclosure, as claimed.

DETAILED DESCRIPTION

Figure 1:
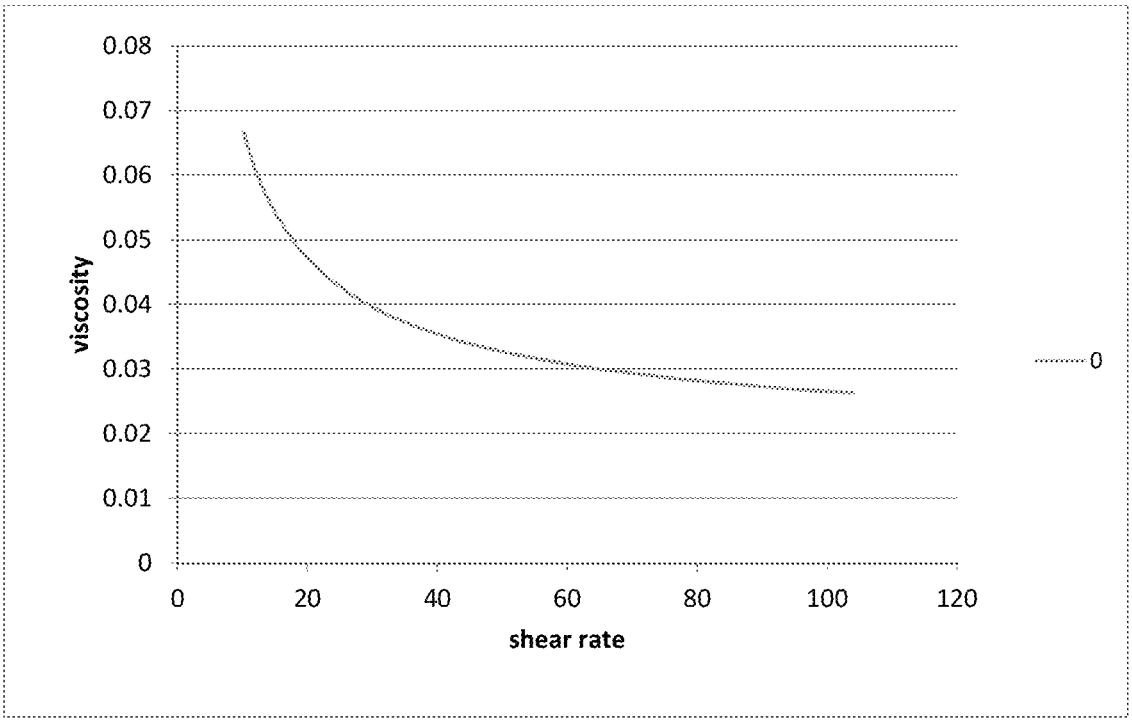
FIG. 1 is a graph showing the viscosity versus shear rate for a sooted oil without dispersant.

To ensure smooth operation of engines, engine oils play an important role in lubricating a variety of sliding parts in the engine, for example, piston rings/cylinder liners, bearings of crankshafts and connecting rods, valve mechanisms including cams and valve lifters, and the like. Engine oils may also play a role in cooling the inside of an engine and dispersing combustion products. Further possible functions of engine oils may include preventing or reducing rust and corrosion.

The principle consideration for engine oils is to prevent wear and seizure of parts in the engine. Lubricated engine parts are mostly in a state of fluid lubrication, but valve systems and top and bottom dead centers of pistons are likely to be in a state of boundary and/or thin-film lubrication. The friction between these parts in the engine may cause significant energy losses and thereby reduce fuel efficiency. Many types of friction modifiers have been used in engine oils to decrease frictional energy losses.

Improved fuel efficiency may be achieved when friction between engine parts is reduced. Thin-film friction is friction generated by a fluid, such as a lubricant, moving between two surfaces, when the distance between the two surfaces is very small. It is known that some additives normally present in engine oils form films of different thicknesses, which can have an effect on thin-film friction. Some additives, such as zinc dialkyldithiophosphate (ZDDP) are known to increase thin-film friction. Though such additives may be required for other reasons such as to protect engine parts, the increase in thin-film friction caused by such additives can be detrimental.

Providing acceptable soot and sludge handling properties to an engine lubricant composition is desirable. The introduction of dispersants into the lubricant compositions has been successful to provide the desired soot and sludge handling properties for lubricant compositions used in certain types of engines. However, heavy duty diesel (HDD) and direct gasoline injection engines (GDi engines), as well as some other types of engines, produce a larger amount of soot and sludge as compared to many other types of internal combustion engines. To address this problem, one option is to increase the treat rate of the dispersant that is used in lubricant compositions for HDD and GDi engines.

Typically, increasing the treat rate of a dispersant within a lubricant composition improves the soot and sludge handling properties of the lubricant composition. Due to the relatively larger amount of soot and sludge produced by HDD and GDi engines, high treat rates of dispersants are needed in the lubricant compositions to provide sufficient soot and sludge handling properties. However, increasing the dispersant treat rate in the engine oil composition beyond a certain level may be undesirable since deleterious effects on engine components, or performance may result. Specifically, high treat rates of dispersants are known to damage engine seals and enhance corrosion.

Although the use of dispersants in a lubricant composition to provide soot and sludge handling properties is known, reducing the treat rates of such dispersants, especially in lubricant compositions destined for use in HDD and GDi engines and other engines that produce large quantities of soot, is necessary to improve the performance of such lubricant compositions in important bench tests such as the high temperature corrosion bench test (HTCBT) of ASTM D-6594 and the seal compatibility test of ASTM D-7216, as well as original equipment manufacturer (OEM) seal tests from, for example, Mercedes Benz, MTU, and MAN Truck & Bus Company.

The present invention provides engine oil compositions which include a dispersant and methods of lubricating an engine using the engine oil compositions. These methods improve boundary layer friction and/or thin film friction, relative to engine oil compositions containing similar conventional dispersant(s) while at the same time providing satisfactory soot and sludge handling properties, as shown by their effective concentrations. In fact, certain dispersants or combinations of dispersants provide soot and sludge handling properties suitable for meeting or exceeding currently proposed and future lubricant performance standards using lower than expected effective concentrations.

In some embodiments where the present invention may be most effective, the engine oil compositions may comprise from 1.0-3.0 wt % soot, or from 2.0-3.0 wt % soot.

Dispersants having certain characteristics may provide beneficial soot and sludge handling properties to an engine lubricant composition while at the same time providing good boundary layer and/or thin film friction.

In many cases, these particular dispersants allow for use of a lower effective concentration of the dispersant in combination with one or more other dispersants in the lubricant composition than would be expected from the calculated effective concentration based on measured effects for each of the two or more dispersants of the combination when used alone. The effect of a particular dispersant combination would be expected to be the sum of the effects of the individual dispersants forming the dispersant combination.

The effective concentration is defined as the concentration of the dispersant in the engine oil that is sufficient to obtain Newtonian fluid behavior for the engine oil composition. Newtonian fluid behavior is measured using a rheometer. Oil containing soot is treated with one or more dispersants and the rheometer is used to determine the concentration at which a Newtonian fluid is obtained. A Newtonian fluid is obtained when the slope of the curve of the viscosity versus shear rate is equal to zero. The concentration of the dispersant at which the slope is zero is the effective concentration for that dispersant. A suitable method for determining effective concentration is described in U.S. Patent application publication no. US 2017/0335228 A1.

Without being bound by theory, in one aspect the polarity created by the nitrogen within the combination of dispersants interacts with the soot contained in the lubricant composition. Additionally, the olefin copolymer tails, for example, polyisobutylene (PIB) tails and aromaticity of, for example, naphthalic anhydride, are believed to help prevent soot from agglomerating into larger soot particles in the lubricant composition. The combination of these aspects is believed to provide handling of soot and sludge in a lubricant composition at lower effective concentrations of the dispersant combination.

Dispersants

In a first embodiment, the engine oil composition includes a dispersant that is a reaction product of: A) a hydrocarbyl-dicarboxylic acid or anhydride and B) at least one polyamine that is post-treated with component C) an aromatic anhydride, an aromatic polycarboxylic acid, or an aromatic anhydride. All carboxylic acid or anhydride groups of component C), the aromatic carboxylic acid, the aromatic polycarboxylic acid, or the aromatic anhydride are attached directly to an aromatic ring.

This dispersant is made from components A)-C) using a molar ratio of carboxyl groups from components A) and C) to nitrogen atoms from component B) of from 0.9 to 1.3.

Components A)-C) used to make this dispersant are described in greater detail below. Methods for making this dispersant are described, for example, in JP2008-127435 and U.S. Pat. No. 8,927,469.

In one embodiment, component A) is a polyisobutenyl-substituted succinic anhydride. This dispersant may have a molar ratio of component A), the polyisobutenyl-substituted succinic anhydride to B), the polyamine, in a range of from 1.0 to 2.2; or from 1.1 to 2.0; or from 1.1 to 1.8; or from 1.2 to 1.6.

In another embodiment, this dispersant is not post treated with a non-aromatic dicarboxylic acid or anhydride having a number average molecular weight of less than about 500 g/mol, as measured by GPC using polystyrene as a calibration reference.

The lubricant composition described herein may contain about 0.1 weight percent to about 8 wt % of the dispersant derived from components A)-C), based on the total weight of the lubricant composition. Another range of the amount of the dispersant derived from components A)-C) may be from about 0.25 wt % to about 5.5 wt. %, based on the total weight of the lubricant composition. A narrower range of the amount of the dispersant may be from about 3.5 wt % to about 5.5 wt. %, based on the total weight of the lubricant composition.

Component A)

Component A) is a hydrocarbyl-dicarboxylic acid or anhydride. The hydrocarbyl moiety of the hydrocarbyl-dicarboxylic acid or anhydride of component A) may be derived from butene polymers, for example polymers of isobutylene. Suitable polyisobutenes for use herein include those formed from polyisobutylene or highly reactive polyisobutylene having at least about 60%, such as about 70% to about 90% and above, terminal vinylidene content. Suitable polyisobutenes may include those prepared using $BF_3$ catalysts. The average number molecular weight of the polyalkenyl substituent may vary over a wide range, for example from about 100 to about 5000, such as from about 500 to about 5000, as determined by GPC using polystyrene as a calibration reference. In one embodiment, the hydrocarbyl-dicarboxylic acid or anhydride of Component A) includes a polyisobutenyl-substituted succinic anhydride.

The hydrocarbyl moiety of the hydrocarbyl-dicarboxylic acid or anhydride of Component A) may alternatively be derived from ethylene-alpha olefin copolymers. These copolymers contain a plurality of ethylene units and a plurality of one or more $C_3$-$C_{10}$ alpha-olefin units. The $C_3$-$C_{10}$ alpha-olefin units may include propylene units.

The ethylene-alpha olefin copolymer typically has a number average molecular weight of less than 5,000 g/mol, as measured by GPC using polystyrene as a calibration reference; or the number average molecular weight of the copolymer may be less than 4,000 g/mol, or less than 3,500 g/mol, or less than 3,000 g/mol, or less than 2,500 g/mol, or less than 2,000 g/mol, or less than 1,500 g/mol, or less than 1,000 g/mol. In some embodiments, the number average molecular weight of the copolymer may be between 800 and 3,000 g/mol.

The ethylene content of the ethylene-alpha olefin copolymer may less than 80 mol %; less than 70 mol %, or less than 65 mol %, or less than 60 mol %, or less than 55 mol %, or less than 50 mol %, or less than 45 mol %, or less than 40 mol %. The ethylene content of the copolymer may be at least 10 mol % and less than 80 mol %, or at least 20 mol % and less than 70 mol %, or at least 30 mol % and less than 65 mol %, or at least 40 mol % and less than 60 mol %.

The $C_3$-$C_{10}$ alpha-olefin content of the ethylene-alpha olefin copolymer may be at least 20 mol %, or at least 30 mol %, or at least 35 mol %, or at least 40 mol %, or at least 45 mol %, or at least 50 mol %, or at least 55 mol %, or at least 60 mol %.

In some embodiments, at least 70 mol % of molecules of the ethylene-alpha olefin copolymer may have an unsaturated group, and at least 70 mol % of said unsaturated groups may be located in a terminal vinylidene group or a tri-substituted isomer of a terminal vinylidene group or at least 75 mol % of the copolymer terminates in the terminal vinylidene group or the tri-substituted isomer of the terminal vinylidene group, or at least 80 mol % of the copolymer terminates in the terminal vinylidene group or the tri-substituted isomer of the terminal vinylidene group, or at least 80 mol % of the copolymer terminates in the terminal vinylidene group or the tri-substituted isomer of the terminal vinylidene group, or at least 85 mol % of the copolymer terminates in the terminal vinylidene group or the tri-substituted isomer of the terminal vinylidene group, or at least 90 mol % of the copolymer terminates in the terminal vinylidene group or the tri-substituted isomer of the terminal vinylidene group, or at least 95 mol % of the copolymer terminates in the terminal vinylidene group or the tri-substituted isomer of the terminal vinylidene group. the terminal vinylidene and the tri-substituted isomers of the terminal vinylidene of the copolymer have one or more of the following structural formulas (I)-(III):

(I)

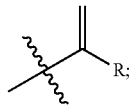

(II)

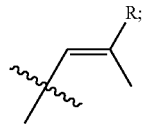

and/or

-continued (III)

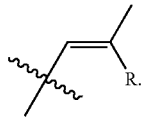

wherein R represents a $C_1$-$C_8$ alkyl group and

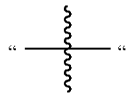

indicates the bond is attached to the remaining portion of the copolymer.

The ethylene-alpha olefin copolymer may have an average ethylene unit run length ($n_{C2}$) which is less than 2.8, as determined by $^{13}$C NMR spectroscopy, and also satisfies the relationship shown by the expression below:

$$n_{C2} < \frac{(EEE + EEA + AEA)}{(AEA + 0.5EEA)}$$

wherein $$EEE = (x_{C2})^3,$$

$$EEA = 2(x_{C2})^2(1 - x_{C2}),$$

$$AEA = x_{C2}(1 - x_{C2})^2,$$

$x_{C2}$ being the mole fraction of ethylene incorporated in the polymer as measured by $^1$H-NMR spectroscopy, E representing an ethylene unit, and A representing an alpha-olefin unit. The copolymer may have an average ethylene unit run length of less than 2.6, or less than 2.4, or less than 2.2, or less than 2. The average ethylene run length $n_{c2}$ may also satisfy the relationship shown by the expression below:

wherein $n_{C2,Actual} < n_{C2,Statistical}$.

The crossover temperature of the ethylene-alpha olefin copolymer may be −20° C. or lower, or −25° C. or lower, or −30° C. or lower, or −35° C. or lower, or −40° C. or lower. The copolymer may have a polydispersity index of less than or equal to 4, or less than or equal to 3, or less than or equal to 2. Less than 20% of unit triads in the copolymer may be ethylene-ethylene-ethylene triads, or less than 10% of unit triads in the copolymer are ethylene-ethylene-ethylene triads, or less than 5% of unit triads in the copolymer are ethylene-ethylene-ethylene triads. Further details of the ethylene-alpha olefin copolymers and dispersants made therefrom may be found in PCT/US18/37116 filed at the U.S. Receiving Office, the disclosure of which is hereby incorporated by reference in its entirety.

The dicarboxylic acid or anhydride of Component A) may be selected from maleic anhydride or from carboxylic reactants other than maleic anhydride, such as maleic acid, fumaric acid, malic acid, tartaric acid, itaconic acid, itaconic anhydride, citraconic acid, citraconic anhydride, mesaconic acid, ethylmaleic anhydride, dimethylmaleic anhydride, ethylmaleic acid, dimethylmaleic acid, hexylmaleic acid, and the like, including the corresponding acid halides and lower aliphatic esters. A suitable dicarboxylic anhydride is maleic anhydride. The molar ratio of maleic anhydride to hydrocarbyl moiety in a reaction mixture used to make Component A may vary widely. Accordingly, the molar ratio may vary from about 5:1 to about 1:5, for example from about 3:1 to about 1:3, and as a further example, the maleic anhydride may be used in stoichiometric excess to force the reaction to completion. The unreacted maleic anhydride may be removed by vacuum distillation.

Component B)

Any of numerous polyamines can be used as Component B) in preparing the dispersant. The polyamine Component B) may be a polyalkylene polyamine. Non-limiting exemplary polyamines may include ethylene diamine, propane diamine, butane diamine, diethylene triamine (DETA), triethylene tetramine (TETA), pentaethylene hexamine (PEHA), aminoethyl piperazine, tetraethylene pentamine (TEPA), N-methyl-1,3-propane diamine, N,N'-dimethyl-1,3-propane diamine, aminoguanidine bicarbonate (AGBC), and heavy polyamines such as E100 heavy amine bottoms. A heavy polyamine may comprise a mixture of polyalkylenepolyamines having small amounts of lower polyamine oligomers such as TEPA and PEHA, but primarily oligomers having seven or more nitrogen atoms, two or more primary amines per molecule, and more extensive branching than conventional polyamine mixtures. Additional non-limiting polyamines which may be used to prepare the hydrocarbyl-substituted succinimide dispersant are disclosed in U.S. Pat. No. 6,548,458, the disclosure of which is incorporated herein by reference in its entirety. The polyamines used as Component B) in the reactions to form the dispersant can be independently selected from the group of triethylene tetraamine, tetraethylene pentamine, diethylene triamine, and ethylene diamine, E100 heavy amine bottoms, and combinations thereof. In another embodiment, the polyamine used as component B) is selected from triethylenepentamine, triethylenetetraamine, diethylenetriamine, and ethylene diamine. In another embodiment, the polyamine used as component B) may be tetraethylene pentamine (TEPA).

In an embodiment, the dispersant may be derived from compounds of formula (I):

(I)

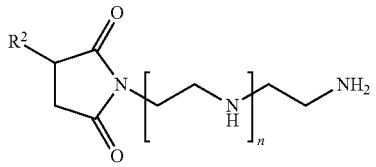

wherein n represents 0 or an integer of from 1 to 5, and $R^2$ is a hydrocarbyl substituent as defined above. In an embodiment, n is 3 and $R^2$ is a polyisobutenyl substituent, such as that derived from polyisobutylenes having at least about 60%, such as about 70% to about 90% and above, terminal vinylidene content. The dispersant may be a compound of the Formula (I). Compounds of formula (I) may be the reaction product of a hydrocarbyl-substituted succinic anhydride, such as a polyisobutenyl succinic anhydride (PIBSA), and a polyamine, for example tetraethylene pentamine (TEPA).

The foregoing compound of formula (I) may have a molar ratio of A) polyisobutenyl-substituted succinic anhydride to B) polyamine, in a range of from 1.0 to 2.2, or from 1.1 to 2.0, or from 1.1 to 1.8; or from 1.2 to 1.6 except that when component B) has an average of 4-6 nitrogen atoms per molecule, the molar ratio of A) to B) may be from 1.0 to 1.6 or from 1.1 to 1.6 or from 1.2 to 1.6. When component B)

has other than an average of 4-6 nitrogen atoms per molecule, the molar ratio of A) to B) may be from 1.0 to 2.0. or when component B) has an average of 4-6 nitrogen atoms per molecule, the molar ratio of A) to B) may be from 1.1 to 1.8 and when component B) has other than an average of 4-6 nitrogen atoms per molecule, the molar ratio of A) to B) may be from 1.1 to 1.8.

A particularly useful dispersant contains polyisobutenyl group of the polyisobutenyl-substituted succinic anhydride having a number average molecular weight (Mn) in the range of from about 500 to 5000 as determined by GPC using polystyrene as a calibration reference and B) a polyamine having a general formula $H_2N(CH_2)m$-[NH $(CH_2)_m]_n$—$NH_2$, wherein m is in the range from 2 to 4 and n is in the range of from 1 to 2. A) can be a polyisobutylene succinic anhydride (PIBSA). The PIBSA or A) may have an average of between about 1.0 and about 2.0 succinic acid moieties per polymer molecule, A) can have an average of 2.0 succinic acid moieties per polymer molecule.

Examples of N-substituted long chain alkenyl succinimides of the Formula (1) include polyisobutylene succinimide with number average molecular weight of the polyisobutylene substituent in the range about 350 to about 50,000, or to about 5,000, or to about 3,000. Succinimide dispersants and their preparation are disclosed, for instance in U.S. Pat. Nos. 7,897,696 or 4,234,435. The polyolefin may be prepared from polymerizable monomers containing about 2 to about 16, or about 2 to about 8, or about 2 to about 6 carbon atoms.

In an embodiment the dispersant is derived from polyisobutylene with number average molecular weight in the range about 350 to about 50,000, or to about 5000, or to about 3000, as determined by GPC using polystyrene as a calibration reference. In some embodiments, polyisobutylene, when included, may have greater than 50 mol %, greater than 60 mol %, greater than 70 mol %, greater than 80 mol %, or greater than 90 mol % content of terminal double bonds. Such PIB is also referred to as highly reactive PIB ("HR-PIB"). HR-PIB having a number average molecular weight ranging from about 800 to about 5000 is suitable for use in embodiments of the present disclosure. Conventional PIB typically has less than 50 mol %, less than 40 mol %, less than 30 mol %, less than 20 mol %, or less than 10 mol % content of terminal double bonds. The % actives of the alkenyl or alkyl succinic anhydride can be determined using a chromatographic technique. This method is described in column 5 and 6 in U.S. Pat. No. 5,334,321.

An HR-PIB having a number average molecular weight ranging from about 900 to about 3000 may be suitable. Such an HR-PIB is commercially available, or can be synthesized by the polymerization of isobutene in the presence of a non-chlorinated catalyst such as boron trifluoride, as described in U.S. Pat. No. 4,152,499 to Boerzel, et al. and U.S. Pat. No. 5,739,355 to Gateau, et al. When used in the aforementioned thermal ene reaction, HR-PIB may lead to higher conversion rates in the reaction, as well as lower amounts of sediment formation, due to increased reactivity. A suitable method is described in U.S. Pat. No. 7,897,696.

Component C)

Component C) is a post-treatment component for the reaction product of A) and B). Component C) is an aromatic carboxylic acid, an aromatic polycarboxylic acid, or an aromatic anhydride wherein all carboxylic acid or anhydride group(s) are attached directly to an aromatic ring. Component C) may be a dicarboxyl-containing fused aromatic compound or anhydride thereof.

Such carboxyl-containing aromatic compounds may be selected from 1,8-naphthalic acid or anhydride, 1,2-naphthalenedicarboxylic acid or anhydride, 2,3-naphthalenedicarboxylic acid or anhydride, naphthalene-1,4-dicarboxylic acid, naphthalene-2,6-dicarboxylic acid, phthalic anhydride, pyromellitic anhydride, 1,2,4-benzene tricarboxylic acid anhydride, diphenic acid or anhydride, 2,3-pyridine dicarboxylic acid or anhydride, 3,4-pyridine dicarboxylic acid or anhydride, 1,4,5,8-naphthalenetetracarboxylic acid or anhydride, perylene-3,4,9,10-tetracarboxylic anhydride, pyrene dicarboxylic acid or anhydride, and the like. Component C) may be a dicarboxyl-containing fused aromatic compound or anhydride thereof. In another embodiment, component C) is 1,8-naphthalic anhydride.

The post-treatment step may be carried out upon completion of the reaction of components A) and B). Post-treatment component C) may be reacted with the reaction product of components A) and B) at a temperature ranging from about 140° C. to about 180° C.

In one embodiment, the dispersant is not post-treated with a non-aromatic dicarboxylic acid or anhydride having a number average molecular weight of less than 500, as measured by GPC using polystyrene as a calibration reference, or the dispersant is not post-treated with maleic anhydride.

A suitable dispersant may also be post-treated by conventional methods with any of a variety of agents. Among these are boron, urea, thiourea, dimercaptothiadiazoles, carbon disulfide, aldehydes, ketones, carboxylic acids, hydrocarbon-substituted succinic anhydrides, maleic anhydride, nitriles, epoxides, carbonates, cyclic carbonates, hindered phenolic esters, and phosphorus compounds. U.S. Pat. Nos. 7,645,726; 7,214,649; and 8,048,831 are incorporated herein by reference in their entireties.

In addition to the carbonate and boric acids post-treatments the dispersants may be post-treated, or further post-treated, with a variety of post-treatments designed to improve or impart different properties. Such post-treatments include those summarized in columns 27-29 of U.S. Pat. No. 5,241,003, hereby incorporated by reference.

The dispersant has a molar ratio of carboxyl groups from components A) and C) to nitrogen atoms from component B) of from 0.9 to 1.3; or from 1.0 to 1.3. The molar ratio of carboxyl groups from components A) and C) to nitrogen atoms from component B) may be varied depending on the component B) used to make the dispersant. For example, if tetraethylene pentamine is used as component B), then a molar ratio of carboxyl groups from components A) and C) to nitrogen atoms from component B) may be 1.0-1.3. If triethylene tetramine or polyamine bottoms such as polyamine bottoms E100 (having an average of 6.5 nitrogen atoms per molecule) is employed as component B), a molar ratio of carboxyl groups from components A) and C) to nitrogen atoms from component B) may be 0.9-1.3

The dispersant may also have a molar ratio of component C) to polyamine component B) of at least 0.4, or at least 0.5, or at least 0.6. In one embodiment, where component B) is triethylene tetramine, the molar ratio of component C) to polyamine component B) in the dispersant is at least 0.4. The upper limit of the molar ratio of component C) to polyamine component B) in the dispersant may be 2.0. The molar ratio of moles of component C) to moles of polyamine component B) in the dispersant of may be from 0.4-2.0 or from 0.5-2.0 or from 0.6 to 2.0.

The molar ratio of component C) to component B) in the dispersant may be from 0.1:1 to 2.5:1, or from 0.2:1 to 2:1, or from 0.25:1 to 1.6:1.

In some embodiments, component A) is a polyisobutenyl-substituted succinic anhydride and the dispersant has a molar ratio of A) polyisobutenyl-substituted succinic anhydride to B) polyamine, in a range of from 1.0 to 2.2; or from 1.1 to 2.0; or from 1.2 to 1.6 except when component B) has an average of 4-6 nitrogen atoms per molecule, the molar ratio of A) to B) may be from 1.0 to 1.6.

The TBN of the dispersant may be from about 10 to about 65 on an oil-free basis, which is comparable to about 5 to about 30 TBN if measured on a dispersant sample containing about 50% diluent oil.

In addition to the foregoing dispersant, the lubricant composition contains a base oil, and may include other conventional ingredients, including but not limited to, friction modifiers, additional dispersants, metal detergents, anti-wear agents, antifoam agents, antioxidants, viscosity modifiers, pour point depressants, corrosion inhibitors and the like.

Optional Additional Dispersant(s)

The lubricant composition of the invention may optionally contain one or more additional dispersants in addition to the dispersant described above. The second and third dispersants, if present, can be used in an amount sufficient to provide up to about 10 wt % of total dispersant, or from about 0.1 wt % to about 10 wt %, or about 0.1 wt % to about 10 wt %, or about 3 wt % to about 8 wt %, or about 1 wt % to about 6 wt %, based upon the final weight of the engine oil composition. In some embodiments, the optional additional dispersant(s) may be employed in an amount of 0.05-9.9 wt. %, or from 0.1 to 8.5 wt. %, or from 0.25 to 6.5 wt. % or from 1-5 wt. %, based on the total weight of the engine oil composition.

Thus, in some embodiments, the engine oil composition includes a combination of the dispersant made from components A)-C) and a second dispersant. The second dispersant may be a reaction product of: D) a hydrocarbyl-dicarboxylic acid or anhydride; and E) at least one polyamine. Component D) may be any of the compounds of component A) described above. Component E) may be any of the polyamines described above for component B).

In one embodiment, component D) is a polyisobutenyl-substituted succinic anhydride. The second dispersant may have a molar ratio of component D) to component E) in a range of from 1.0 to 2.0; or from 1.1 to 1.8; or from 1.2 to 1.6.

The engine oil compositions may have a weight ratio of the second dispersant to the dispersant reaction product of A) and B) post-treated with C) of from about 0.1:1.0 to 1.0:1.0; or 0.25:1.0 to 0.75:1.0; or 0.4:1.0 to 0.6:1.0.

In another embodiment, the hydrocarbyl-dicarboxylic acid or anhydride of components D) and A) may each include a polyisobutenyl-substituted succinic anhydride. If the second dispersant is derived from a compound of the formula (I), it may have a molar ratio of D) polyisobutenyl-substituted succinic anhydride to E) polyamine in the range of from 1.0 to 2.0, or from 1.1 to 1.8, or from 1.2 to 1.6, or from 1.4 or 1.6.

In an alternative embodiment, a combination of three or more dispersant additives may be used to create the desired effect. The third dispersant may be selected from the dispersants derived from components A)-C) and the dispersants derived from components D)-E), or may be a different dispersant. The third dispersant can include a polyisobutenyl succinic acid or anhydride. The third dispersant may be a reaction product of F) a hydrocarbyl-dicarboxylic acid or anhydride and G) at least one polyamine. In some cases, the third dispersant may be post-treated with H) boric acid. Alternatively, the third dispersant may be a reaction product of F) a hydrocarbyl-dicarboxylic acid or anhydride, and G) at least one polyamine, wherein the reaction product is post-treated with I) an aromatic carboxylic acid, an aromatic polycarboxylic acid, or an aromatic anhydride wherein all carboxylic acid or anhydride groups are attached directly to an aromatic ring, and/or J) a non-aromatic dicarboxylic acid or anhydride having a number average molecular weight of less than about 500, as measured by GPC using polystyrene as a calibration reference.

Additional dispersants contained in the lubricant composition may include, but are not limited to, any dispersants having an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. Dispersants may be selected from Mannich dispersants as described in U.S. Pat. Nos. 3,697,574 and 3,736,357; ashless succinimide dispersants as described in U.S. Pat. Nos. 4,234,435 and 4,636,322; amine dispersants as described in U.S. Pat. Nos. 3,219,666, 3,565,804, and 5,633,326; Koch dispersants as described in U.S. Pat. Nos. 5,936,041, 5,643,859, and 5,627,259, and polyalkylene succinimide dispersants as described in U.S. Pat. Nos. 5,851,965; 5,853,434; and 5,792,729.

In various embodiments, the additional dispersant may be derived from a polyalphaolefin (PAO) succinic anhydride, an olefin maleic anhydride copolymer. As an example, the additional dispersant may be described as a poly-PIBSA. In another embodiment, the additional dispersant may be derived from an anhydride which is grafted to an ethylene-propylene copolymer. Another additional dispersant may be a high molecular weight ester or half ester amide.

Another class of additional dispersants may be Mannich bases. Mannich bases are materials that are formed by the condensation of a higher molecular weight, alkyl substituted phenol, a polyalkylene polyamine, and an aldehyde such as formaldehyde. Mannich bases are described in more detail in U.S. Pat. No. 3,634,515.

The third dispersant may be a reaction product of A) a hydrocarbyl-dicarboxylic acid or anhydride, and B) at least one polyamine wherein the reaction product is post-treated with a non-aromatic dicarboxylic acid or anhydride having a number average molecular weight of less than about 500, as measured by GPC using polystyrene as a calibration reference.

In an embodiment where the engine oil composition includes a third dispersant and the weight ratio of the second dispersant to the dispersant derived from components A)-C) to the third dispersant may be from about 1:5:2 to 1:6:2; or from 1:4:2 to 1:5:2; or 1:3:2 to 1:4:2.

Base Oil

The base oil used in the engine oil compositions herein may be selected from any of the base oils in Groups I-V as specified in the American Petroleum Institute (API) Base Oil Interchangeability Guidelines. The five base oil groups are as follows:

| Base oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥120 |

-continued

| Base oil Category | Sulfur (%) | Saturates (%) | Viscosity Index |
|---|---|---|---|
| Group IV | All polyalphaolefins (PAOs) | | |
| Group V | All others not included in Groups I, II, III, or IV | | |

Groups I, II, and III are mineral oil process stocks. Group IV base oils contain true synthetic molecular species, which are produced by polymerization of olefinically unsaturated hydrocarbons. Many Group V base oils are also true synthetic products and may include diesters, polyol esters, polyalkylene glycols, alkylated aromatics, polyphosphate esters, polyvinyl ethers, and/or polyphenyl ethers, and the like, but may also be naturally occurring oils, such as vegetable oils. It should be noted that although Group III base oils are derived from mineral oil, the rigorous processing that these fluids undergo causes their physical properties to be very similar to some true synthetics, such as PAOs. Therefore, oils derived from Group III base oils may be referred to as synthetic fluids in the industry.

The base oil used in the disclosed engine oil composition may be a mineral oil, animal oil, vegetable oil, synthetic oil, or mixtures thereof. Suitable oils may be derived from hydrocracking, hydrogenation, hydrofinishing, unrefined, refined, and re-refined oils, and mixtures thereof.

Unrefined oils are those derived from a natural, mineral, or synthetic source without or with little further purification treatment. Refined oils are similar to the unrefined oils except that they have been treated in one or more purification steps, which may result in the improvement of one or more properties. Examples of suitable purification techniques are solvent extraction, secondary distillation, acid or base extraction, filtration, percolation, and the like. Oils refined to the quality of an edible may or may not be useful. Edible oils may also be called white oils. In some embodiments, engine oil compositions are free of edible or white oils.

Re-refined oils are also known as reclaimed or reprocessed oils. These oils are obtained similarly to refined oils using the same or similar processes. Often these oils are additionally processed by techniques directed to removal of spent additives and oil breakdown products.

Mineral oils may include oils obtained by drilling or from plants and animals or any mixtures thereof. For example such oils may include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully hydrogenated, if desired. Oils derived from coal or shale may also be useful.

Useful synthetic lubricating oils may include hydrocarbon oils such as polymerized, oligomerized, or interpolymerized olefins (e.g., polybutylenes, polypropylenes, propylene isobutylene copolymers); poly(1-hexenes), poly(1-octenes), trimers or oligomers of 1-decene, e.g., poly(1-decenes), such materials being often referred to as α-olefins, and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Polyalphaolefins are typically hydrogenated materials.

Other synthetic lubricating oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

The major amount of base oil included in the engine oil composition may be selected from the group consisting of Group I, Group II, a Group III, a Group IV, a Group V, and a combination of two or more of the foregoing, and wherein the major amount of base oil is other than base oils that arise from provision of additive components or viscosity index improvers in the composition. In a further embodiment, not more than 10 wt. % of the base may be a Group IV or Group V base oil. In another embodiment, the major amount of base oil included in the engine oil composition may be selected from the group consisting of a Group II, a Group III, a Group IV, a Group V, and a combination of two or more of the foregoing, and wherein the major amount of base oil is other than base oils that arise from provision of additive components or viscosity index improvers in the composition.

The amount of the oil of lubricating viscosity present may be the balance remaining after subtracting from 100 wt % the sum of the amount of the performance additives inclusive of viscosity index improver(s) and/or pour point depressant(s) and/or other top treat additives. For example, the oil of lubricating viscosity that may be present in a finished fluid may be a major amount, such as greater than about 50 wt %, greater than about 60 wt %, greater than about 70 wt %, greater than about 80 wt %, greater than about 85 wt %, or greater than about 90 wt %.

Antioxidants

The engine oil compositions herein also may optionally contain one or more antioxidants. Antioxidant compounds are known and include for example, phenates, phenate sulfides, sulfurized olefins, phosphosulfurized terpenes, sulfurized esters, aromatic amines, alkylated diphenylamines (e.g., nonyl diphenylamine, di-nonyl diphenylamine, octyl diphenylamine, di-octyl diphenylamine), phenyl-alpha-naphthylamines, alkylated phenyl-alpha-naphthylamines, hindered non-aromatic amines, phenols, hindered phenols, oil-soluble molybdenum compounds, macromolecular antioxidants, or mixtures thereof. Antioxidant compounds may be used alone or in combination.

The hindered phenol antioxidant may contain a secondary butyl and/or a tertiary butyl group as a sterically hindering group. The phenol group may be further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 available from BASF or an addition product derived from 2,6-di-tert-butylphenol and an alkyl acrylate, wherein the alkyl group may contain about 1 to about 18, or about 2 to about 12, or about 2 to about 8, or about 2 to about 6, or about 4 carbon atoms. Another commercially available hindered phenol antioxidant may be an ester and may include Ethanox™ 4716 available from Albemarle Corporation.

Useful antioxidants may include diarylamines and high molecular weight phenols. In an embodiment, the engine oil composition may contain a mixture of a diarylamine and a high molecular weight phenol, such that each antioxidant may be present in an amount sufficient to provide up to about 5%, by weight, based upon the final weight of the engine oil composition. In an embodiment, the antioxidant may be a mixture of about 0.3 to about 1.5% diarylamine and about 0.4 to about 2.5% high molecular weight phenol, by weight, based upon the final weight of the engine oil composition.

Examples of suitable olefins that may be sulfurized to form a sulfurized olefin include propylene, butylene, isobutylene, polyisobutylene, pentene, hexene, heptene, octene, nonene, decene, undecene, dodecene, tridecene, tetradecene, pentadecene, hexadecene, heptadecene, octadecene, nonadecene, eicosene or mixtures thereof. In one embodiment, hexadecene, heptadecene, octadecene, nonadecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulfurized olefin includes sulfurized fatty acids and their esters. The fatty acids are often obtained from vegetable oil or animal oil and typically contain about 4 to about 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. Fatty acids and/or ester may be mixed with olefins, such as α-olefins.

The one or more antioxidant(s) may be present in ranges about 0 wt % to about 20 wt %, or about 0.1 wt % to about 10 wt %, or about 1 wt % to about 5 wt %, of the engine oil composition.

Antiwear Agents

The engine oil compositions herein also may optionally contain one or more antiwear agents. Examples of suitable antiwear agents include, but are not limited to, a metal thiophosphate; a metal dialkyldithiophosphate; a phosphoric acid ester or salt thereof; a phosphate ester(s); a phosphite; a phosphorus-containing carboxylic ester, ether, or amide; a sulfurized olefin; thiocarbamate-containing compounds including, thiocarbamate esters, alkylene-coupled thiocarbamates, and bis(S-alkyldithiocarbamyl)disulfides; and mixtures thereof. A suitable antiwear agent may be a molybdenum dithiocarbamate. The phosphorus containing antiwear agents are more fully described in European Patent 612 839. The metal in the dialkyl dithio phosphate salts may be an alkali metal, alkaline earth metal, aluminum, lead, tin, molybdenum, manganese, nickel, copper, titanium, or zinc. A useful antiwear agent may be zinc dialkylthiophosphate.

Further examples of suitable antiwear agents include titanium compounds, tartrates, tartrimides, oil soluble amine salts of phosphorus compounds, sulfurized olefins, phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl) disulfides. The tartrate or tartrimide may contain alkyl-ester groups, where the sum of carbon atoms on the alkyl groups may be at least 8. The antiwear agent may in one embodiment include a citrate.

The antiwear agent may be present in ranges including about 0 wt % to about 15 wt %, or about 0.01 wt % to about 10 wt %, or about 0.05 wt % to about 5 wt %, or about 0.1 wt % to about 3 wt % of the engine oil composition.

Boron-Containing Compounds

The engine oil compositions herein may optionally contain one or more boron-containing compounds.

Examples of boron-containing compounds include borate esters, borated fatty amines, borated epoxides, borated detergents, and borated dispersants, such as borated succinimide dispersants, as disclosed in U.S. Pat. No. 5,883,057.

The boron-containing compound, if present, can be used in an amount sufficient to provide up to about 8 wt %, about 0.01 wt % to about 7 wt %, about 0.05 wt % to about 5 wt %, or about 0.1 wt % to about 3 wt % of the engine oil composition.

Detergents

The engine oil composition may optionally further comprise one or more neutral, low based, or overbased detergents, and mixtures thereof. Suitable detergent substrates include phenates, sulfur containing phenates, sulfonates, calixarates, salixarates, salicylates, carboxylic acids, phosphorus acids, mono- and/or di-thiophosphoric acids, alkyl phenols, sulfur coupled alkyl phenol compounds, or methylene bridged phenols. Suitable detergents and their methods of preparation are described in greater detail in numerous patent publications, including U.S. Pat. No. 7,732,390 and references cited therein. The detergent substrate may be salted with an alkali or alkaline earth metal such as, but not limited to, calcium, magnesium, potassium, sodium, lithium, barium, or mixtures thereof. In some embodiments, the detergent is free of barium. A suitable detergent may include alkali or alkaline earth metal salts of petroleum sulfonic acids and long chain mono- or di-alkylarylsulfonic acids with the aryl group being benzyl, tolyl, and xylyl. Examples of suitable detergents include, but are not limited to, calcium phenates, calcium sulfur containing phenates, calcium sulfonates, calcium calixarates, calcium salixarates, calcium salicylates, calcium carboxylic acids, calcium phosphorus acids, calcium mono- and/or di-thiophosphoric acids, calcium alkyl phenols, calcium sulfur coupled alkyl phenol compounds, calcium methylene bridged phenols, magnesium phenates, magnesium sulfur containing phenates, magnesium sulfonates, magnesium calixarates, magnesium salixarates, magnesium salicylates, magnesium carboxylic acids, magnesium phosphorus acids, magnesium mono- and/or di-thiophosphoric acids, magnesium alkyl phenols, magnesium sulfur coupled alkyl phenol compounds, magnesium methylene bridged phenols, sodium phenates, sodium sulfur containing phenates, sodium sulfonates, sodium calixarates, sodium salixarates, sodium salicylates, sodium carboxylic acids, sodium phosphorus acids, sodium mono- and/or di-thiophosphoric acids, sodium alkyl phenols, sodium sulfur coupled alkyl phenol compounds, or sodium methylene bridged phenols.

Overbased detergent additives are well known in the art and may be alkali or alkaline earth metal overbased detergent additives. Such detergent additives may be prepared by reacting a metal oxide or metal hydroxide with a substrate and carbon dioxide gas. The substrate is typically an acid, for example, an acid such as an aliphatic substituted sulfonic acid, an aliphatic substituted carboxylic acid, or an aliphatic substituted phenol.

The terminology "overbased" relates to metal salts, such as metal salts of sulfonates, carboxylates, and phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, MR, is greater than one. They are commonly referred to as overbased, hyperbased, or superbased salts and may be salts of organic sulfur acids, carboxylic acids, or phenols.

An overbased detergent of the engine oil composition may have a total base number (TBN) of about 200 mg KOH/gram or greater, or as further examples, about 250 mg KOH/gram or greater, or about 350 mg KOH/gram or greater, or about 375 mg KOH/gram or greater, or about 400 mg KOH/gram or greater.

Examples of suitable overbased detergents include, but are not limited to, overbased calcium phenates, overbased calcium sulfur containing phenates, overbased calcium sulfonates, overbased calcium calixarates, overbased calcium salixarates, overbased calcium salicylates, overbased calcium carboxylic acids, overbased calcium phosphorus acids, overbased calcium mono- and/or di-thiophosphoric acids, overbased calcium alkyl phenols, overbased calcium sulfur coupled alkyl phenol compounds, overbased calcium methylene bridged phenols, overbased magnesium phenates, overbased magnesium sulfur containing phenates, overbased magnesium sulfonates, overbased magnesium calixarates, overbased magnesium salixarates, overbased magnesium salicylates, overbased magnesium carboxylic acids, overbased magnesium phosphorus acids, overbased magnesium mono- and/or di-thiophosphoric acids, overbased magnesium alkyl phenols, overbased magnesium sulfur coupled alkyl phenol compounds, or overbased magnesium methylene bridged phenols.

The overbased detergent may have a metal to substrate ratio of from 1.1:1, or from 2:1, or from 4:1, or from 5:1, or from 7:1, or from 10:1.

In some embodiments, a detergent is effective at reducing or preventing rust in an engine.

The detergent may be present at about 0 wt % to about 10 wt %, or about 0.1 wt % to about 8 wt %, or about 1 wt % to about 4 wt %, or greater than about 4 wt % to about 8 wt %.

Friction Modifiers

The engine oil compositions herein also may optionally contain one or more friction modifiers. Suitable friction modifiers may comprise metal containing and metal-free friction modifiers and may include, but are not limited to, imidazolines, amides, amines, succinimides, alkoxylated amines, alkoxylated ether amines, amine oxides, amidoamines, nitriles, betaines, quaternary amines, imines, amine salts, amino guanadine, alkanolamides, phosphonates, metal-containing compounds, glycerol esters, sulfurized fatty compounds and olefins, sunflower oil other naturally occurring plant or animal oils, dicarboxylic acid esters, esters or partial esters of a polyol and one or more aliphatic or aromatic carboxylic acids, and the like.

Suitable friction modifiers may contain hydrocarbyl groups that are selected from straight chain, branched chain, or aromatic hydrocarbyl groups or mixtures thereof, and may be saturated or unsaturated. The hydrocarbyl groups may be composed of carbon and hydrogen or hetero atoms such as sulfur or oxygen. The hydrocarbyl groups may range from about 12 to about 25 carbon atoms. In some embodiments the friction modifier may be a long chain fatty acid ester. In another embodiment the long chain fatty acid ester may be a mono-ester, or a di-ester, or a (tri)glyceride. The friction modifier may be a long chain fatty amide, a long chain fatty ester, a long chain fatty epoxide derivative, or a long chain imidazoline.

Other suitable friction modifiers may include organic, ashless (metal-free), nitrogen-free organic friction modifiers. Such friction modifiers may include esters formed by reacting carboxylic acids and anhydrides with alkanols and generally include a polar terminal group (e.g. carboxyl or hydroxyl) covalently bonded to an oleophilic hydrocarbon chain. An example of an organic ashless nitrogen-free friction modifier is known generally as glycerol monooleate (GMO) which may contain mono-, di-, and tri-esters of oleic acid. Other suitable friction modifiers are described in U.S. Pat. No. 6,723,685, herein incorporated by reference in its entirety.

Aminic friction modifiers may include amines or polyamines. Such compounds can have hydrocarbyl groups that are linear, either saturated or unsaturated, or a mixture thereof and may contain from about 12 to about 25 carbon atoms. Further examples of suitable friction modifiers include alkoxylated amines and alkoxylated ether amines. Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291, herein incorporated by reference in its entirety.

A friction modifier may optionally be present in ranges such as about 0 wt % to about 10 wt %, or about 0.01 wt % to about 8 wt %, or about 0.1 wt % to about 4 wt %.

Molybdenum-Containing Component

The engine oil compositions herein also may optionally contain one or more molybdenum-containing compounds. An oil-soluble molybdenum compound may have the functional performance of an antiwear agent, an antioxidant, a friction modifier, or mixtures thereof. An oil-soluble molybdenum compound may include molybdenum dithiocarbamates, molybdenum dialkyldithiophosphates, molybdenum dithiophosphinates, amine salts of molybdenum compounds, molybdenum xanthates, molybdenum thioxanthates, molybdenum sulfides, molybdenum carboxylates, molybdenum alkoxides, a trinuclear organo-molybdenum compound, and/or mixtures thereof. The molybdenum sulfides include molybdenum disulfide. The molybdenum disulfide may be in the form of a stable dispersion. In one embodiment the oil-soluble molybdenum compound may be selected from the group consisting of molybdenum dithiocarbamates, molybdenum dialkyldithiophosphates, amine salts of molybdenum compounds, and mixtures thereof. In one embodiment the oil-soluble molybdenum compound may be a molybdenum dithiocarbamate.

Suitable examples of molybdenum compounds which may be used include commercial materials sold under the trade names such as Molyvan 822™, Molyvan™ A, Molyvan 2000™ and Molyvan 855™ from R. T. Vanderbilt Co., Ltd., and Sakura-Lube™ S-165, S-200, S-300, 5-310G, S-525, S-600, S-700, and S-710 available from Adeka Corporation, and mixtures thereof. Suitable molybdenum components are described in U.S. Pat. Nos. 5,650,381; RE 37,363 E1; RE 38,929 E1; and RE 40,595 E1, incorporated herein by reference in their entireties.

Additionally, the molybdenum compound may be an acidic molybdenum compound. Included are molybdic acid, ammonium molybdate, sodium molybdate, potassium molybdate, and other alkaline metal molybdates and other molybdenum salts, e.g., hydrogen sodium molybdate, MoOCl4, MoO2Br2, Mo2O3Cl6, molybdenum trioxide or similar acidic molybdenum compounds. Alternatively, the compositions can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and WO 94/06897, incorporated herein by reference in their entireties.

Another class of suitable organo-molybdenum compounds are trinuclear molybdenum compounds, such as those of the formula Mo3SkLnQz and mixtures thereof, wherein S represents sulfur, L represents independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms may be present among all the ligands' organo groups, such as at least 25, at least 30, or at least 35 carbon atoms. Additional suitable molybdenum compounds are described in U.S. Pat. No. 6,723,685, herein incorporated by reference in its entirety.

The oil-soluble molybdenum compound may be present in an amount sufficient to provide about 0.5 ppm to about 2000 ppm, about 1 ppm to about 700 ppm, about 1 ppm to about 550 ppm, about 5 ppm to about 300 ppm, or about 20 ppm to about 250 ppm of molybdenum.

Transition Metal-Containing Compounds

In another embodiment, the oil-soluble compound may be a transition metal containing compound or a metalloid. The transition metals may include, but are not limited to, titanium, vanadium, copper, zinc, zirconium, molybdenum, tantalum, tungsten, and the like. Suitable metalloids include, but are not limited to, boron, silicon, antimony, tellurium, and the like.

In an embodiment, an oil-soluble transition metal-containing compound may function as antiwear agents, friction modifiers, antioxidants, deposit control additives, or more than one of these functions. In an embodiment the oil-soluble transition metal-containing compound may be an oil-soluble titanium compound, such as a titanium (IV) alkoxide. Among the titanium containing compounds that may be used in, or which may be used for preparation of the oils-soluble materials of, the disclosed technology are various Ti (IV) compounds such as titanium (IV) oxide; titanium (IV) sulfide; titanium (IV) nitrate; titanium (IV) alkoxides such as titanium methoxide, titanium ethoxide, titanium propoxide, titanium isopropoxide, titanium butoxide, titanium 2-ethylhexoxide; and other titanium compounds or complexes including but not limited to titanium phenates; titanium carboxylates such as titanium (IV) 2-ethyl-1-3-hexanedioate or titanium citrate or titanium oleate; and titanium (IV) (triethanolaminato)isopropoxide. Other forms of titanium encompassed within the disclosed technology include titanium phosphates such as titanium dithiophosphates (e.g., dialkyldithiophosphates) and titanium sulfonates (e.g., alkylbenzenesulfonates), or, generally, the reaction product of titanium compounds with various acid materials to form salts, such as oil-soluble salts. Titanium compounds can thus be derived from, among others, organic acids, alcohols, and glycols. Ti compounds may also exist in dimeric or oligomeric form, containing Ti—O—Ti structures. Such titanium materials are commercially available or can be readily prepared by appropriate synthesis techniques which will be apparent to the person skilled in the art. They may exist at room temperature as a solid or a liquid, depending on the particular compound. They may also be provided in a solution form in an appropriate inert solvent.

In one embodiment, the titanium can be supplied as a Ti-modified dispersant, such as a succinimide dispersant. Such materials may be prepared by forming a titanium mixed anhydride between a titanium alkoxide and a hydrocarbyl-substituted succinic anhydride, such as an alkenyl- (or alkyl) succinic anhydride. The resulting titanate-succinate intermediate may be used directly or it may be reacted with any of a number of materials, such as (a) a polyamine-based succinimide/amide dispersant having free, condensable —NH functionality; (b) the components of a polyamine-based succinimide/amide dispersant, i.e., an alkenyl- (or alkyl-) succinic anhydride and a polyamine, (c) a hydroxy-containing polyester dispersant prepared by the reaction of a substituted succinic anhydride with a polyol, aminoalcohol, polyamine, or mixtures thereof. Alternatively, the titanate-succinate intermediate may be reacted with other agents such as alcohols, aminoalcohols, ether alcohols, polyether alcohols or polyols, or fatty acids, and the product thereof either used directly to impart Ti to a lubricant, or else further reacted with the succinic dispersants as described above. As an example, 1 part (by mole) of tetraisopropyl titanate may be reacted with about 2 parts (by mole) of a polyisobutene-substituted succinic anhydride at 140-150° C. for 5 to 6 hours to provide a titanium modified dispersant or intermediate. The resulting material (30 g) may be further reacted with a succinimide dispersant from polyisobutene-substituted succinic anhydride and a polyethylenepolyamine mixture (127 grams+diluent oil) at 150° C. for 1.5 hours, to produce a titanium-modified succinimide dispersant.

Another titanium containing compound may be a reaction product of titanium alkoxide and $C_6$ to $C_{25}$ carboxylic acid. The reaction product may be represented by the following formula:

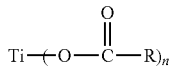

wherein n is an integer selected from 2, 3 and 4, and R is a hydrocarbyl group containing from about 5 to about 24 carbon atoms, or by the formula:

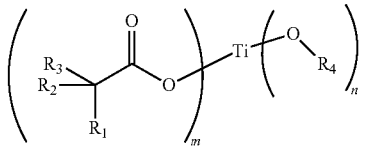

wherein m+n=4 and n ranges from 1 to 3, $R_4$ is an alkyl moiety with carbon atoms ranging from 1-8, $R_1$ is selected from a hydrocarbyl group containing from about 6 to 25 carbon atoms, and $R_2$ and $R_3$ are the same or different and are selected from a hydrocarbyl group containing from about 1 to 6 carbon atoms, or the titanium compound may be represented by the formula:

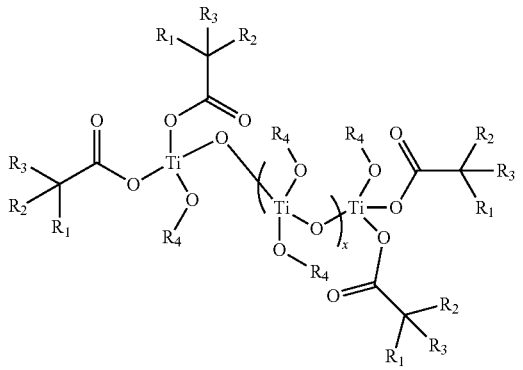

wherein x ranges from 0 to 3, $R_1$ is selected from a hydrocarbyl group containing from about 6 to 25 carbon atoms, $R_2$, and $R_3$ are the same or different and are selected from a hydrocarbyl group containing from about 1 to 6 carbon atoms, and $R_4$ is selected from a group consisting of either H, or $C_6$ to $C_{25}$ carboxylic acid moiety.

Suitable carboxylic acids may include, but are not limited to caproic acid, caprylic acid, lauric acid, myristic acid, palmitic acid, stearic acid, arachidic acid, oleic acid, erucic acid, linoleic acid, linolenic acid, cyclohexanecarboxylic acid, phenylacetic acid, benzoic acid, neodecanoic acid, and the like.

In an embodiment the oil soluble titanium compound may be present in the engine oil composition in an amount to provide from 0 to 3000 ppm titanium by weight or 25 to about 1500 ppm titanium by weight or about 35 ppm to 500 ppm titanium by weight or about 50 ppm to about 300 ppm.

Viscosity Index Improvers

The engine oil compositions herein also may optionally contain one or more viscosity index improvers. Suitable viscosity index improvers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity index improvers may include star polymers and suitable examples are described in US Publication No. 20120101017A1.

The engine oil compositions herein also may optionally contain one or more dispersant viscosity index improvers in addition to a viscosity index improver or in lieu of a viscosity index improver. Suitable viscosity index improvers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity index improver and/or dispersant viscosity index improver may be about 0 wt % to about 20 wt %, about 0.1 wt % to about 15 wt %, about 0.1 wt % to about 12 wt %, or about 0.5 wt % to about 10 wt %, of the engine oil composition.

Other Optional Additives

Other additives may be selected to perform one or more functions required of an engine oil. Further, one or more of the mentioned additives may be multi-functional and provide functions in addition to or other than the function prescribed herein.

A engine oil composition according to the present disclosure may optionally comprise other performance additives. The other performance additives may be in addition to specified additives of the present disclosure and/or may comprise one or more of metal deactivators, viscosity index improvers, detergents, ashless TBN boosters, friction modifiers, antiwear agents, corrosion inhibitors, rust inhibitors, dispersants, dispersant viscosity index improvers, extreme pressure agents, antioxidants, foam inhibitors, demulsifiers, emulsifiers, pour point depressants, seal swelling agents and mixtures thereof. Typically, fully-formulated engine oil will contain one or more of these performance additives.

Suitable metal deactivators may include derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides.

Suitable foam inhibitors include silicon-based compounds, such as siloxane.

Suitable pour point depressants may include a polymethylmethacrylates or mixtures thereof. Pour point depressants may be present in an amount sufficient to provide from about 0 wt % to about 1 wt %, about 0.01 wt % to about 0.5 wt %, or about 0.02 wt % to about 0.04 wt % based upon the final weight of the engine oil composition.

Suitable rust inhibitors may be a single compound or a mixture of compounds having the property of inhibiting corrosion of ferrous metal surfaces. Non-limiting examples of rust inhibitors useful herein include oil-soluble high molecular weight organic acids, such as 2-ethylhexanoic acid, lauric acid, myristic acid, palmitic acid, oleic acid, linoleic acid, linolenic acid, behenic acid, and cerotic acid, as well as oil-soluble polycarboxylic acids including dimer and trimer acids, such as those produced from tall oil fatty acids, oleic acid, and linoleic acid. Other suitable corrosion inhibitors include long-chain alpha, omega-dicarboxylic acids in the molecular weight range of about 600 to about 3000 and alkenylsuccinic acids in which the alkenyl group contains about 10 or more carbon atoms such as, tetrapropenylsuccinic acid, tetradecenylsuccinic acid, and hexadecenylsuccinic acid. Another useful type of acidic corrosion inhibitors are the half esters of alkenyl succinic acids having about 8 to about 24 carbon atoms in the alkenyl group with alcohols such as the polyglycols. The corresponding half amides of such alkenyl succinic acids are also useful. A useful rust inhibitor is a high molecular weight organic acid. In some embodiments, an engine oil is devoid of a rust inhibitor.

The rust inhibitor, if present, can be used in an amount sufficient to provide about 0 wt % to about 5 wt %, about 0.01 wt % to about 3 wt %, about 0.1 wt % to about 2 wt %, based upon the final weight of the engine oil composition.

In general terms, a suitable lubricant composition may include additive components in the ranges listed in the following Table 1.

TABLE 1

| Component | Wt. % (Suitable Embodiments) | Wt. % (Preferred Embodiments) |
|---|---|---|
| Inventive Dispersant | 0.1-8.0 | 3.5-5.5 |
| Additional Dispersant(s) | 0.0-10.0 | 2.0-5.0 |
| Antioxidant(s) | 0.1-5.0 | 0.01-3.0 |
| Detergent(s) | 0.1-15.0 | 0.2-4.0 |
| Ashless TBN booster(s) | 0.0-1.0 | 0.0-0.5 |
| Corrosion inhibitor(s) | 0.0-5.0 | 0.0-2.0 |
| Metal dihydrocarbyl dithiophosphate(s) | 0.1-6.0 | 0.1-3.0 |
| Antifoaming agent(s) | 0.0-5.0 | 0.001-0.02 |
| Pour point depressant(s) | 0.0-5.0 | 0.01-2 |
| Viscosity index improver(s) | 0.0-20.0 | 0.25-10.0 |
| Dispersant viscosity index improver(s) | 0.0-10.0 | 0.0-5.0 |
| Friction modifier(s) | 0.01-1.0 | 0.05-0.5 |
| Base oil(s) | Balance | Balance |
| Total | 100 | 100 |

The percentages of each component above represent the weight percent of each component, based upon the weight of the final engine oil composition. The remainder of the engine oil composition consists of one or more base oils.

Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent).

In another aspect, the present disclosure relates to a method for lubricating an engine including a step of lubricating an engine with the engine oil composition as set forth herein.

The present disclosure also relates to a method for maintaining the soot or sludge handling capability of an engine oil composition including a step of adding to the engine oil composition the dispersant as set forth in each of the foregoing embodiments.

The present disclosure relates to a method for improving boundary layer friction in an engine, including a step of lubricating the engine with the engine oil composition as set forth in each of the foregoing embodiments. The improvement in boundary layer friction may be determined relative to a same composition in the absence of the dispersant reaction product of A) and B) post-treated with C).

The present disclosure relates to a method for improving thin film friction in an engine, including a step of lubricating the engine with the engine oil composition as set forth in each of the foregoing embodiments. The improvement in the thin film friction may be determined relative to a same composition in the absence of the dispersant reaction product of A) and B) post-treated with C).

The present disclosure relates to a method for improving a combination of the boundary layer friction and the thin film friction in an engine, including a step of lubricating the engine with the engine oil composition as set forth in each of the foregoing embodiments. The improvement in the combination of the boundary layer friction and the thin film friction may be determined relative to a same composition in the absence of the dispersant reaction product of A) and B) post-treated with C).

EXAMPLES

The following examples are illustrative, but not limiting, of the methods and compositions of the present disclosure. Other suitable modifications and adaptations of the variety of conditions and parameters normally encountered in the field, and which are obvious to those skilled in the art, are within the spirit and scope of the disclosure. All patents and publications cited herein are fully incorporated by reference herein in their entirety.

Examples Showing the Effective Concentration for Soot Dispersancy

In order to evaluate lubricant formulations according to the disclosure, various dispersants were tested for their ability to disperse soot. A sooted oil having 4.3 wt. % soot was generated from a fired diesel engine using a fluid that contained no dispersants. The oil was then tested by a shear rate sweep in a rheometer with a cone on plate to determine Newtonian/non-Newtonian behavior.

The results for the untreated sooted oil are shown in FIG. 1. The untreated sooted oil (curve A containing no dispersant) provided a non-linear curve for viscosity as a function of shear rate, which indicates that it is a non-Newtonian fluid and that soot is agglomerating in the oil. The higher viscosity that was observed at lower shear indicates soot agglomeration. The slope of the curve for the untreated sooted oil was approximately 0.00038.

The lubricant compositions used in the following examples were prepared using samples of the same sooted oil as prepared above. In each example, a single dispersant was added in varying concentrations to the sooted oil. The amount of sooted oil was varied to provide the balance of the composition to account for the variations in the amount of dispersants used in each lubricant composition.

Each lubricant composition was subjected to a shear rate sweep in a rheometer with a cone on plate to determine Newtonian-non-Newtonian behavior and, to measure the effective concentrations of the dispersants at which Newtonian behavior was observed. All tests were performed at the same constant temperature of 100° C. Several concentrations of dispersant were tested for each lubricant composition. The slope of each curve was calculated. The effective concentration of the dispersant was deemed to be the concentration of the dispersant in the lubricant, at which the lubricant composition exhibited Newtonian behavior. The effective concentration was thus the concentration of dispersant that provided a lubricant composition that exhibited no change in viscosity with shear rate over time. This was determined by finding the concentration of dispersant at which the slope of the curve for viscosity versus shear rate was zero.

Figure 2:
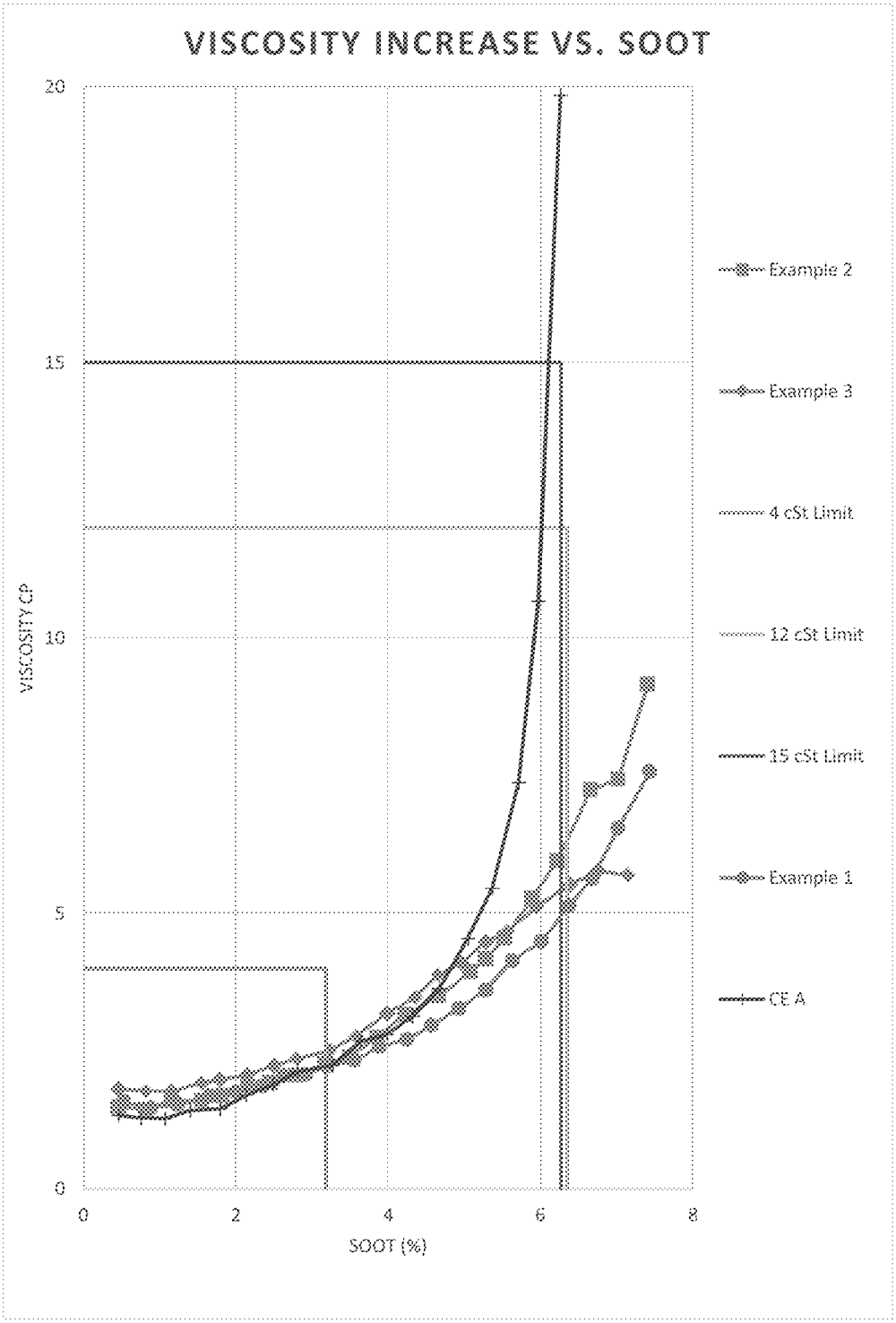
FIG. 2 is a graph showing viscosity increase in test oils as determined using the Mack T-11 Test.

Tests were run on lubricant compositions each containing a base oil and two dispersants, a dispersant as described in the table below and a constant amount of a second dispersant that was a polyisobutenyl-substituted succinic anhydride reacted with polyethylene amine. The following table sets forth the features of each dispersant combination tested for soot effective concentration in a lubricant composition. FIGS. 2 and 3 are graphs showing the soot effective concentration for the lubricant compositions comprising the dispersant combinations set forth in Table 2.

TABLE 2

| | Polyamine Component B) of the Dispersant | PIBSA/ Polyamine Molar Ratio | Moles of C)/ Moles of B) | CO/N* | Soot Effective Concentration Wt % |
|---|---|---|---|---|---|
| Comparative Dispersant 1 | Mixture with an average of 5 nitrogen atoms | 1.7 | 0.69 | 0.96 | 1.01 |
| Comparative Dispersant 2 | TEPA | 3.0 | 0.5 | 1.4 | 2.16 |
| Dispersant A | TETA | 1.2 | 1.0 | 1.1 | 0.81 |
| Dispersant B | TEPA | 1.4 | 1.4 | 1.12 | 0.89 |
| Dispersant C | TEPA | 1.4 | 1.6 | 1.2 | 0.90 |
| Dispersant D | TEPA | 1.6 | 1.6 | 1.28 | 1.12 |
| Dispersant E | TEPA | 1.6 | 1.4 | 1.2 | 1.20 |
| Dispersant F | TEPA | 1.6 | 1.2 | 1.12 | 1.19 |
| Dispersant G | TEPA | 1.6 | 1.0 | 1.04 | 1.08 |
| Dispersant H | TETA | 1.6 | 0.4 | 1.0 | 0.92 |
| Dispersant I | TETA | 1.4 | 0.4 | 0.9 | 0.96 |
| Dispersant J | TETA | 1.4 | 0.6 | 1.0 | 0.85 |
| Dispersant K | TETA | 1.2 | 0.6 | 0.9 | 0.91 |
| Dispersant L | TETA | 1.2 | 0.8 | 1.0 | 0.840 |

*CO/N as used in Tables 2-6, is the molar ratio of carboxyl groups from components A) and C) charged to the reactor to the moles of nitrogen atoms delivered from component B) charged to the reactor to make the dispersant.

The lower soot effective concentration provided by Dispersants A-C and Dispersants H-L relative to Comparative Dispersant 1 indicate that these dispersants provided improved soot dispersancy. Dispersants D-G provided acceptable soot dispersancy.

Examples Using the Mack T-11 Test

A series of fully formulated engine oil compositions were subjected to the Mack T-11 ASTM D 7156-17 EGR engine oil test.

The following examples each contained the same DI package, except for the indicated variations in the dispersant combination. The fully formulated engine oils of the following examples each contained the dispersant set forth in Table 3 and constant amounts of second and third dispersants.

TABLE 3

| Example | Dispersant wt. % | Dispersant | PIBSA/ Polyamine Molar Ratio | Moles of C)/ Moles of B) | CO/N |
|---|---|---|---|---|---|
| Comparative Example A | 5.5 | Comparative Dispersant 1 | 1.7 | 0.69 | 0.96 |
| Example 1 | 5.5 | Dispersant A | 1.2 | 1.0 | 1.1 |
| Example 2 | 4.5 | Dispersant B | 1.4 | 1.4 | 1.12 |
| Example 3 | 3.5 | Dispersant A | 1.2 | 1.0 | 1.1 |

The results of the Mack T-11 test may be found in FIG. 2. As seen in FIG. 2, Examples 1-3 which contained the inventive dispersant combinations, passed the Mack T-11 test and Comparative Example A failed the Mack T-11 test. In Examples 2 and 3, this result was obtained using 18% and 36% less dispersant than was used in Comparative Example A, respectively.

Examples Testing for Boundary Layer Friction

The following examples tested various fully formulated engine oils for boundary layer friction regime friction coefficients. Each one of the examples comprised 2 wt % of the indicated dispersant and the remainder was base oil.

High Frequency Reciprocating Rig

The engine oil lubricants were subjected to the High Frequency Reciprocating Rig (HFRR) test. A HFRR from PCS Instruments was used to measure boundary lubrication regime friction coefficients. The test samples were measured by submerging the contact between an SAE 52100 metal ball and an SAE 52100 metal disk in a temperature controlled bath under a fixed load forwards and backwards at a set stroke frequency. The ability of the lubricant to reduce boundary layer friction is reflected by the determined boundary lubrication regime friction coefficients. A lower value is indicative of lower friction.

The dispersants in Table 4 were prepared from tetraethylene pentamine. The dispersants in Table 5 were prepared from triethylene tetramine. The dispersants in Table 6 were prepared with an amine mixture having an average of 6.5 nitrogen atoms per molecule. The dispersant used in Comparative Example G was based on components A)-C) and additionally post-treated with maleic anhydride.

TABLE 4

| Example | PIBSA/ Polyamine Molar Ratio | Moles of C)/ Moles of B) | CO/N | HFRR Coefficient of Friction at 2 wt % |
|---|---|---|---|---|
| Comparative Example B | 2 | 0.25 | 0.9 | 0.171 |
| Comparative Example C | 1.8 | 0.5 | 0.92 | 0.172 |
| Example 4 (using Dispersant E) | 1.6 | 1.4 | 1.2 | 0.166 |
| Example 5 (using Dispersant F) | 1.6 | 1.2 | 1.12 | 0.164 |
| Example 6 (using Dispersant D) | 1.6 | 1.6 | 1.28 | 0.164 |
| Example 7 (using Dispersant C) | 1.4 | 1.6 | 1.2 | 0.166 |
| Example 8 (using Dispersant B) | 1.4 | 1.4 | 1.12 | 0.162 |
| Example 9 (using Dispersant B) | 1.4 | 1.4 | 1.12 | 0.164 |
| Example 10 (using Dispersant B) | 1.4 | 1.4 | 1.12 | 0.162 |
| Example 11 | 1.4 | 1.5 | 1.16 | 0.167 |
| Comparative Example D (using Comparative Dispersant 2) | 3 | 0.5 | 1.4 | 0.174 |
| Comparative Example E | 3 | 1.0 | 1.6 | 0.176 |

TABLE 5

| Example | PIBSA/ Polyamine Molar Ratio | Moles of C)/ Moles of B) | CO/N | HFRR Coefficient of Friction at 2 wt % |
|---|---|---|---|---|
| Example 12 (using Dispersant J) | 1.4 | 0.6 | 1.0 | 0.164 |
| Example 13 (using Dispersant I) | 1.4 | 0.4 | 0.9 | 0.156 |
| Example 14 | 1.2 | 1.4 | 1.3 | 0.160 |
| Example 15 (using Dispersant A) | 1.2 | 1 | 1.1 | 0.156 |
| Example 16 (using Dispersant L) | 1.2 | 0.8 | 1.0 | 0.160 |
| Example 17 (using Dispersant K) | 1.2 | 0.6 | 0.9 | 0.162 |
| Comparative Example F | 1.7 | 0.69 | 1.128 | 0.170 |

TABLE 6

| Example | PIBSA/ Polyamine Molar Ratio | Moles of C)/ Moles of B) | CO/N | HFRR Coefficient of Friction at 2 wt % |
|---|---|---|---|---|
| Example 18 | 2 | 2 | 1.23 | 0.168 |
| Example 19 | 2 | 1 | 0.92 | 0.163 |
| Comparative Example G | 3 | 1.6 | 1.42 | 0.175 |

The coefficient of friction was improved in the inventive examples compared to the comparative examples.

Other embodiments of the present disclosure will be apparent to those skilled in the art from consideration of the specification and practice of the embodiments disclosed herein. As used throughout the specification and claims, "a" and/or "an" may refer to one or more than one. Unless otherwise indicated, all numbers expressing quantities of ingredients, properties such as molecular weight, percent, ratio, reaction conditions, and so forth used in the specification and claims are to be understood as being modified in all instances by the term "about," whether or not the term "about" is present. Accordingly, unless indicated to the contrary, the numerical parameters set forth in the specification and claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. It is intended that the specification and examples be considered as exemplary only, with a true scope and spirit of the disclosure being indicated by the following claims.

The foregoing embodiments are susceptible to considerable variation in practice. Accordingly, the embodiments are not intended to be limited to the specific exemplifications set forth hereinabove. Rather, the foregoing embodiments are within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

What is claimed is:

1. An engine oil composition comprising:

greater than 50% to about 99% by weight of a base oil, based on the total weight of the engine oil composition, and a dispersant that is a reaction product of A) a polyisobutenyl succinic acid or anhydride, and B) at least one polyamine, that is post-treated with C) an aromatic carboxylic acid, an aromatic polycarboxylic acid, or an aromatic anhydride, wherein all carboxylic acid or anhydride groups of C) are attached directly to an aromatic ring, and wherein a molar ratio of carboxyl groups from components A) and C) to nitrogen atoms from component B) of from 1.0 to 1.2 is used to make the dispersant, the dispersant has a molar ratio of component C) to component B) of 1.0 to 1.6, component B) has an average of 4-5 nitrogen atoms per molecule, and a molar ratio of A) to B) is from 1.2 to 1.4; and the engine oil composition comprises 2 wt. % to 5.5 wt. % of the dispersant, based on a total weight of the engine oil composition.

2. The engine oil composition of claim 1, wherein the molar ratio of carboxyl groups from components A) and C) to nitrogen atoms from component B) is from 1.0 to 1.12.

3. The engine oil composition of claim 1, wherein component C) is 1,8-naphthalic anhydride.

4. The engine oil composition of claim 1, wherein the polyamine B) is tetraethylenepentamine.

5. The engine oil composition of claim 1, wherein the dispersant is not post treated with a non-aromatic dicarboxylic acid or anhydride having a number average molecular weight of less than about 500 g/mol, as measured by GPC using polystyrene as a calibration reference.

6. The engine oil composition of claim 1, comprising at least 1.0 wt % soot.

7. A method for lubricating an engine comprising lubricating an engine with the engine oil composition as claimed in claim 1.

8. A method for maintaining the soot or sludge handling capability of an engine oil composition comprising a step of adding to the engine oil composition a dispersant that is a reaction product of A) a polyisobutenyl succinic acid or anhydride, and B) at least one polyamine, that is post-treated with C) an aromatic carboxylic aci, an aromatic polycarboxylic acid, or an aromatic anhydride, wherein all carboxylic acid or anhydride groups of C) are attached directly to an aromatic ring, and wherein a molar ratio of carboxyl groups from components A) and C) to nitrogen atoms from component B) of from 1.0 to 1.2 is used to make the dispersant, and the dispersant has a molar ratio of component C) to component B) of 1.0 to 1.6, component B) has an average of 4-5 nitrogen atoms per molecule, and a molar ratio of A) to B) is from 1.2 to 1.4; and the engine oil composition comprises 2 wt. % to 5.5 wt. % of the dispersant, based on a total weight of the engine oil composition.

9. A method for improving boundary layer friction in an engine, comprising a step of lubricating the engine with the engine oil composition as claimed in claim 1.

10. The method of claim 9, wherein the improvement in boundary layer friction is determined relative to a same composition in the absence of the dispersant.

11. A method for improving thin film friction in an engine, comprising a step of lubicating the engine with the engine oil composition as claimed in claim 1.

12. The method of claim 11, wherein the improvement in thin film friction is determined relative to same composition in the absence of the dispersant.

* * * * *